US012630345B2

(12) United States Patent
Zhou et al.

(10) Patent No.: US 12,630,345 B2
(45) Date of Patent: May 19, 2026

(54) RECYCLABLE POUCH FOR A SHIPPING PACKAGE

(71) Applicant: Federal Express Corporation, Memphis, TN (US)

(72) Inventors: Yongquan Zhou, Oakland, TN (US); Jiada Mo, Memphis, TN (US); Scott Ritchie, Piperton, TN (US)

(73) Assignee: Federal Express Corporation, Memphis, TN (US)

( * ) Notice: Subject to any disclaimer, the term of this patent is extended or adjusted under 35 U.S.C. 154(b) by 0 days.

(21) Appl. No.: 18/412,157

(22) Filed: Jan. 12, 2024

(65) Prior Publication Data

US 2024/0239577 A1 Jul. 18, 2024

Related U.S. Application Data

(60) Provisional application No. 63/513,197, filed on Jul. 12, 2023, provisional application No. 63/509,969, (Continued)

(51) Int. Cl.
*B65D 65/38* (2006.01)
*B65D 77/24* (2006.01)

(52) U.S. Cl.
CPC ..... *B65D 65/38* (2013.01); *B65D 77/24* (2013.01); *B65D 2203/06* (2013.01); *B65D 2565/385* (2013.01)

(58) Field of Classification Search
CPC ..... B65D 2203/06; B65D 73/0042; B65D 73/0021; B65D 73/0028; B65D 73/0057; (Continued)

(56) References Cited

U.S. PATENT DOCUMENTS 3,428,171 A 2/1969 Blish
3,456,784 A 7/1969 Sirago
(Continued)

FOREIGN PATENT DOCUMENTS

DE 9111978 12/1991
WO WO 2002/038470 5/2002
WO WO 2002/048000 6/2002

OTHER PUBLICATIONS

International Search Report and Written Opinion in International Appln. No. PCT/US2021/062688, dated Mar. 17, 2022, 18 pages.

*Primary Examiner* — Robert Poon
(74) *Attorney, Agent, or Firm* — Fish & Richardson P.C.

(57) ABSTRACT

Methods, systems, and apparatus, including a reusable recyclable packing pouch. The reusable recyclable packing pouch includes a plastic container and a paperboard jacket. The plastic container includes a first portion and a second portion. The first portion has a shaped region. The second portion is coupled to the first portion by a hinge, and sized to mate with the first portion such as to define a space between facing surfaces of the second portion and the shaped region of the first portion When the first portion and the second portion are coupled, the plastic container includes a flange extending annularly around the shaped region. The paperboard jacket has an aperture defined therethrough. The aperture is sized to permit the shaped region of the plastic container to pass through while the flange extends past edges of aperture and overlaps with a region of paperboard jacket at a periphery of the aperture.

21 Claims, 22 Drawing Sheets

Related U.S. Application Data filed on Jun. 23, 2023, provisional application No. 63/522,690, filed on Jun. 22, 2023, provisional application No. 63/479,686, filed on Jan. 12, 2023.

(58) Field of Classification Search
CPC ..... B65D 73/0035; B65D 73/0085; B65D 73/0092; B65D 75/545; B65D 75/5805
USPC ..... 206/470, 462, 463, 471, 779, 488
See application file for complete search history.

(56) References Cited

U.S. PATENT DOCUMENTS 4,153,162 A * 5/1979 Samsing ..... B65D 73/0085 206/476
4,953,700 A * 9/1990 DeDino ..... B65D 73/0092 206/704
5,649,621 A * 7/1997 Brody ..... G09F 3/04 206/349
5,899,333 A * 5/1999 Williams ..... B65D 75/322 206/469
6,155,414 A * 12/2000 Vaessen ..... B65D 75/366 206/232
6,308,832 B1 10/2001 Pirro et al.
7,926,660 B2 * 4/2011 Jones ..... B65D 73/0092 206/532
8,616,372 B2 * 12/2013 Wills ..... A61J 1/035 206/463
2002/0088855 A1 7/2002 Hodes
2007/0062836 A1 3/2007 Nazari
2009/0266722 A1 10/2009 Rogers et al.
2013/0319896 A1 * 12/2013 Corbat ..... B65D 75/322 493/56
2018/0251281 A1 * 9/2018 Fuller ..... A45D 40/00
2022/0194662 A1 * 6/2022 Zhou ..... B65D 73/0057
2024/0239577 A1 7/2024 Zhou et al.

* cited by examiner

RECYCLABLE POUCH FOR A SHIPPING PACKAGE

CROSS-REFERENCE TO RELATED APPLICATIONS

This application claims the benefit of the filing date of U.S. Provisional Application No. 63/479,686, filed on Jan. 12, 2023; U.S. Provisional Application No. 63/522,690, filed on Jun. 22, 2023; U.S. Provisional Application No. 63/509,969, filed on Jun. 23, 2023; and U.S. Provisional Application No. 63/513,197, filed on Jul. 12, 2023. The contents of U.S. Application Nos. 63/479,686; 63/522,690; 63/509,969; and 63/513,197 are incorporated herein by reference in their entirety.

BACKGROUND

Packing pouches can be employed in logistics transportation and package shipment as an instrument to contain shipping documents, tracking devices, and monitoring devices. The pouch is attached to a package as the package travels through a distribution channel. Packing pouches are commonly broken open when removing shipping documents, tracking devices, and monitoring devices from the package after use, and are generally not reusable nor recyclable.

SUMMARY

This specification relates to reusable recyclable packing pouches for shipping containers. The reusable recyclable packing pouch includes a plastic container, a paperboard jacket, and an adhesive coating.

Particular implementations of the subject matter described in this specification can be implemented so as to realize one or more of the following advantages. Implementations provide a packing pouch with reusable components. For example, implementations reduce single use plastic components in shipping pouches, and thus, reduce plastic waste entering the environment. Recycling efficiency may be improved by easily separating independently recyclable materials. Implementations may improve shipping monitoring device longevity by providing a durable protective casing. Implementations may improve shipping within a distribution channel for sending and receiving shipments by improving the likelihood that shipping documents are kept with corresponding shipments throughout the journey through the channel. Implementations may reduce the lost or missing of shipments within a distribution channel.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

A distribution channel for sending and receiving shipments generally employs shipping documents to route, sort, and track various shipments flowing through the channel. Shipping documents include, for example, air waybills, shipping labels, invoices, packing lists, and other paperwork related to a shipment. The shipping documents are placed inside a pouch that is attached to a receiving surface such as a package, box, carton, or other container to be shipped through the channel. To insure proper sorting, tracking, import/export, and ultimately, delivery, it is important to keep shipping documents with the shipment throughout the journey through the channel. At the destination, the recipient breaks opens the pouch and removes the shipping documents.

The shipping documents can include items such as packing slips or monitoring devices. Monitoring devices can be larger or shaped such as to require additional protection while enclosed in the pouch. Package monitoring devices that can be placed in a packing pouch include, but are not limited to, devices which monitor location, temperature, humidity, atmospheric pressure, tilt angle, shock, or vibration.

While most shipping packages are made of recyclable corrugated boards, the traditional adhesive plastic pouches and packing list envelopes make recycling shipping packages difficult and costly. The plastic packing pouches and envelopes must be removed before the cardboard board package can be recycle. However, traditional packing pouches and envelopes often stretch, tear, and rarely come off the package in one piece. If not recycled, those plastic pouches and packing list envelopes may be sent to land-fills directly, end up at land-fills, or are dumped into the ocean where they remain and do not be decomposed, polluting the land or ocean. Additionally, these plastic materials may contaminate water and/or injure fish or other marine animals. Implementations of the present disclosure provide a packaging structure that prevents damage to a plastic container when a packaging pouch is open or removed from a shipping package. The plastic container can then be re-used, which minimizes non-biodegradable waste.

Figure 1A:
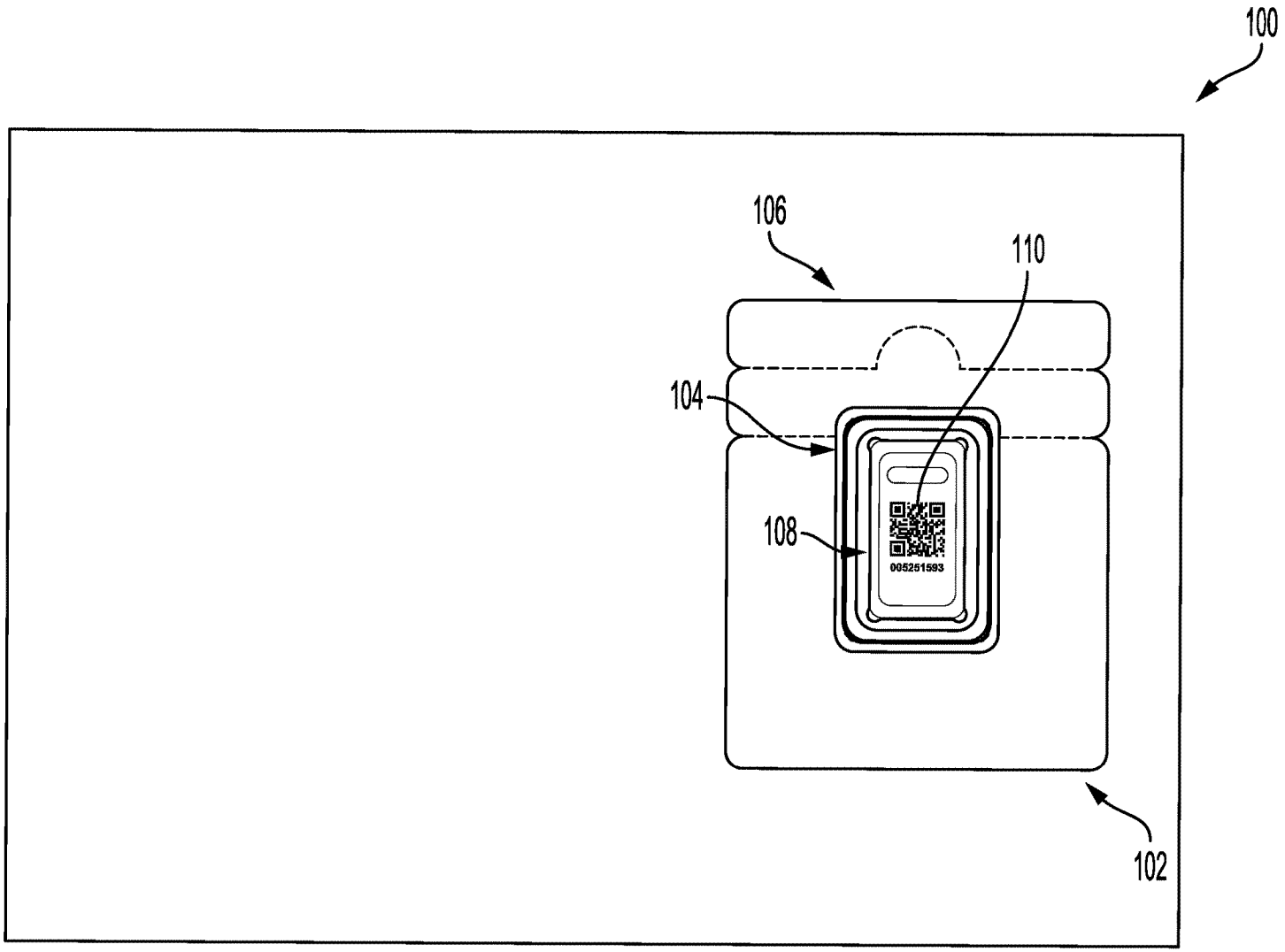
FIG. 1A is a front view of an example reusable recyclable packing pouch affixed to a shipping package.

FIG. 1A illustrates a shipping package 100 with and exemplary reusable recyclable packing pouch 102 attached to a shipping package 100. The packing pouch 102 includes a plastic container 104 and a paperboard jacket 106 attaching the plastic container 104 to the shipping package 100. The plastic container 106 is sized and configured to contain and protect a monitoring device 108. The plastic container 104 is described in more detail in reference to FIGS. 2A-6G. The paperboard jacket is described in more detail in reference to FIGS. 7A-7H and 10A-10B.

As shown in FIG. 1A, the shipping package 100 is ready for shipping. The packing pouch 102 is affixed to an outside surface of the shipping package 100. The paperboard jacket 106 holds the plastic container 104 to the shipping package 100. In the illustrated example, the plastic container 104 contains the monitoring device 108.

The shipping package 100 is one example of a shipping container to which the recyclable shipping pouch 102 can be affixed. For example, the recyclable shipping pouch 102 can be affixed to a cardboard box, a thin paper envelope, a plastic envelope, a unit load device (ULD), a cargo net, a pallet, or a reusable returnable shipping container.

The monitoring device 108 senses a condition or multiple conditions of the shipping container. For example, the monitoring device 108 can track and monitor location, temperature, humidity, atmospheric pressure, tilt angle, shock, or vibration. The monitoring device 108 can include an electronic log or electronic receiver to sense electronic signals. For example, the monitoring device 108 can include an electronic receiver configured to receive satellite signals to determine the shipping container location. For example, the monitoring device 108 can include a GPS receiver. The monitoring device 108 can include an electronic transmitter to transmit shipping container conditions or location. The monitoring device 108 can include a machine readable code 110 which contains information regarding a content of the reusable recyclable packing pouch 102 or the shipping package 100. For example, the machine readable code can be a quick response (QR) code including of a matrixed black and white squares and read by a QR code scanner (not shown). The QR code can contain information regarding a content of the reusable recyclable packing pouch.

Figure 1B:
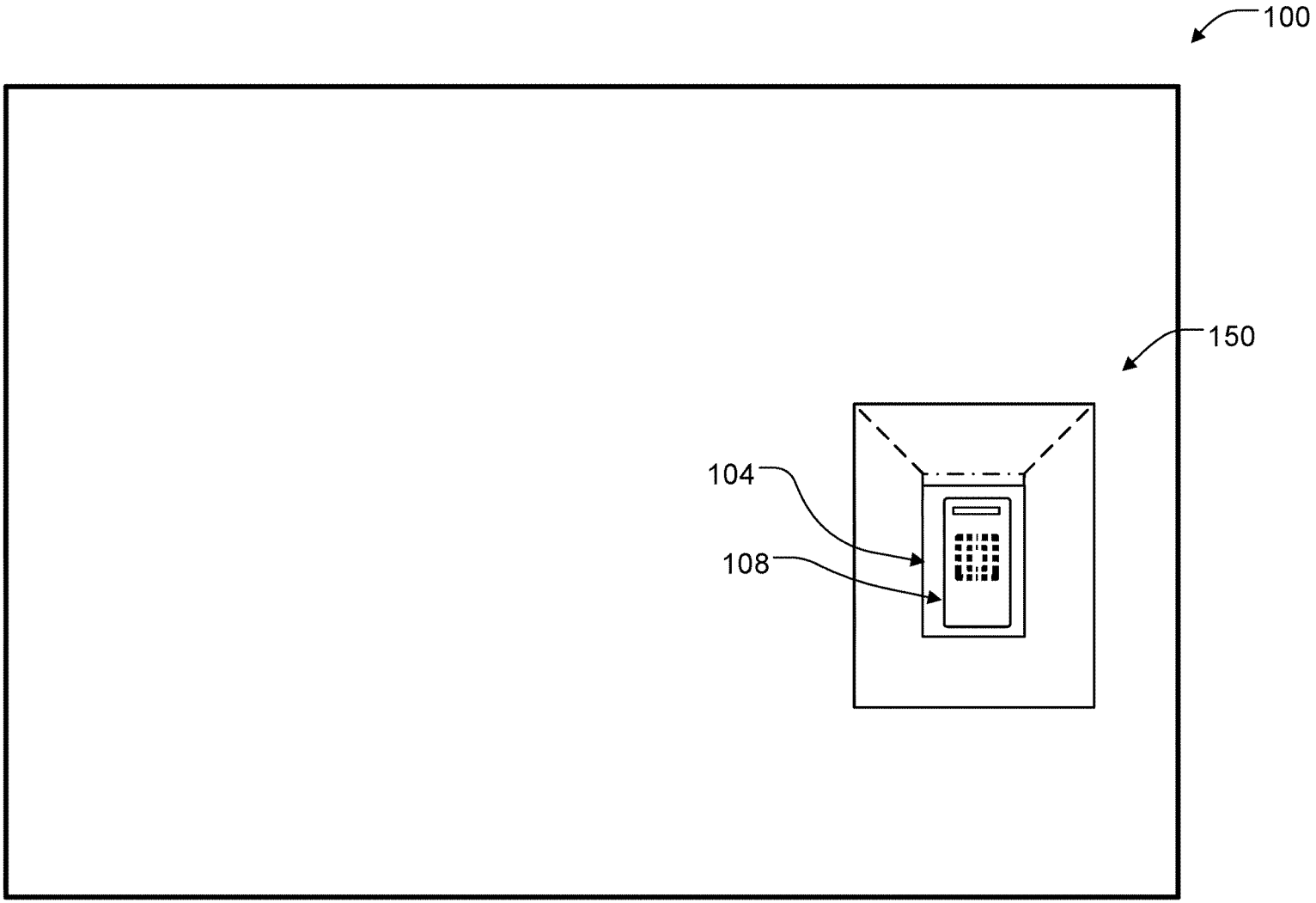
FIG. 1B is a front view of another example reusable recyclable packing pouch affixed to the shipping package.

FIG. 1B is a front view of another example reusable recyclable packing pouch 150 affixed to the shipping package. The reusable recyclable packing pouch 150 can be used with any of the example plastic containers (such as plastic containers 104-604). The reusable recyclable packing pouch 150 has a paperboard jacket 106, described in detail in reference to FIGS. 10A-10B.

Figure 2A:
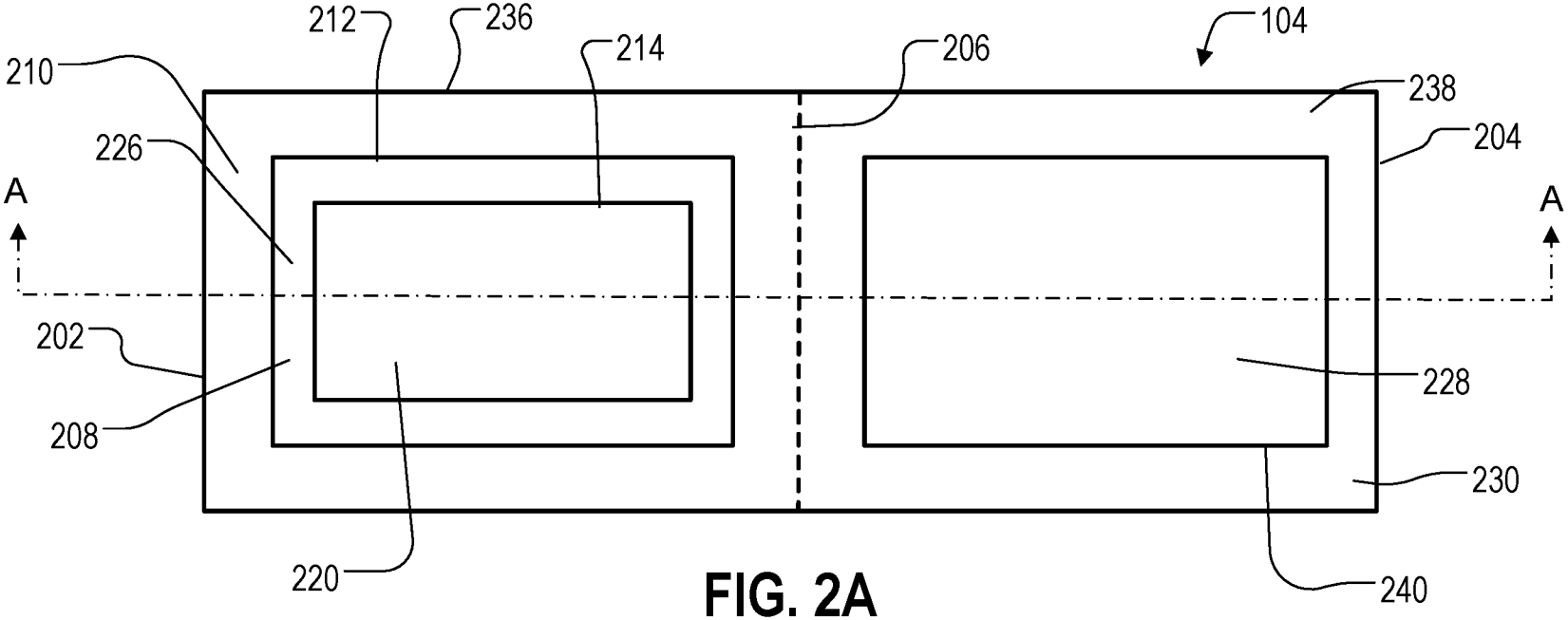
FIG. 2A is a top view of an example plastic container of the reusable recyclable packing pouch of FIGS. 1A-1B.
Figure 2B:
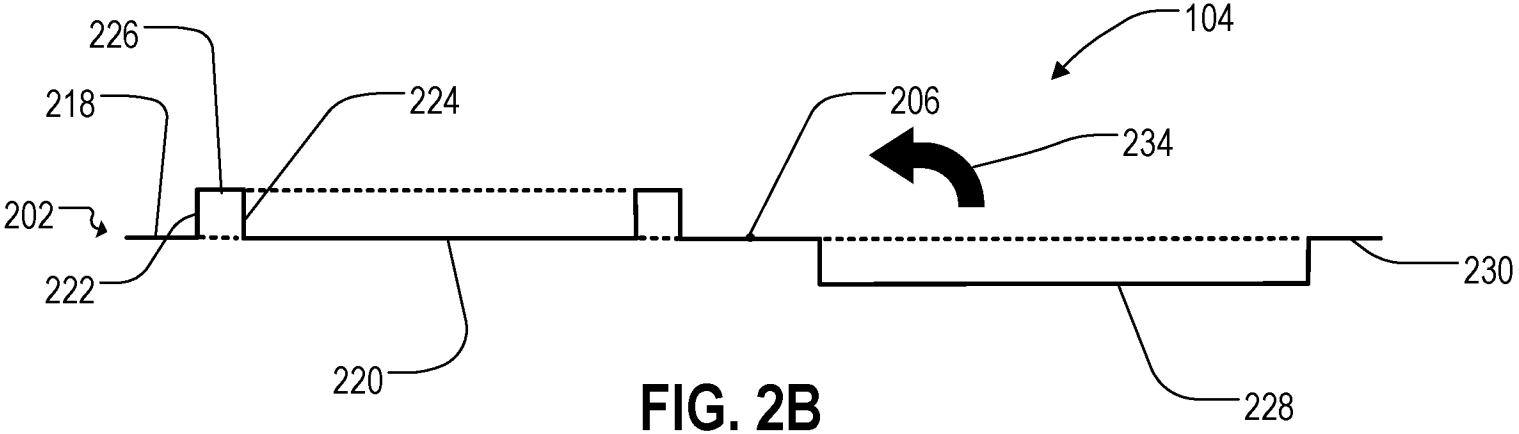
FIG. 2B is a cross-section view of the plastic container of FIG. 2A along cross section A-A with the plastic container open.
Figure 2C:
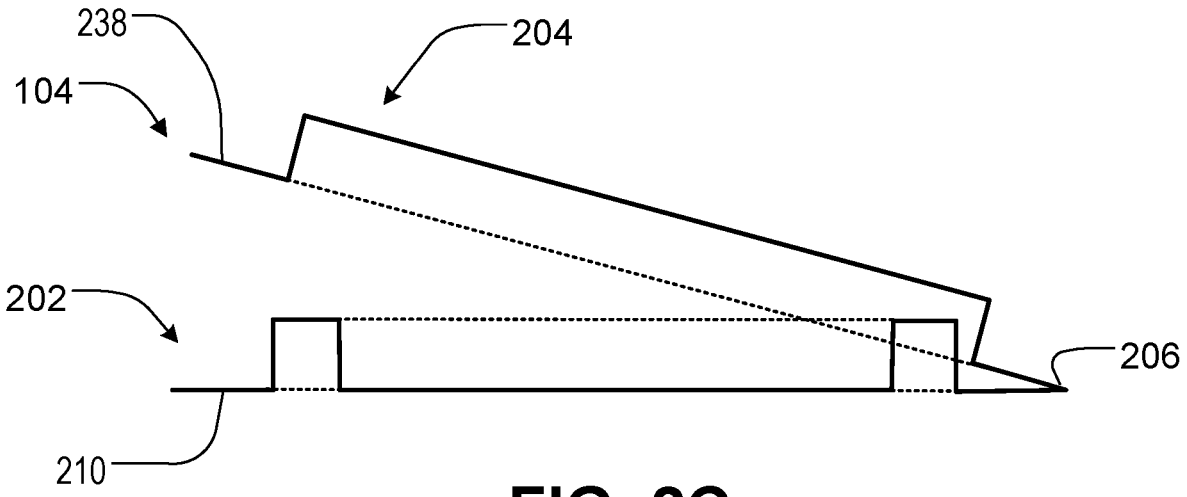
FIG. 2C is a cross-section view of the plastic container of FIG. 2A with the plastic container partially shut.
Figure 2D:
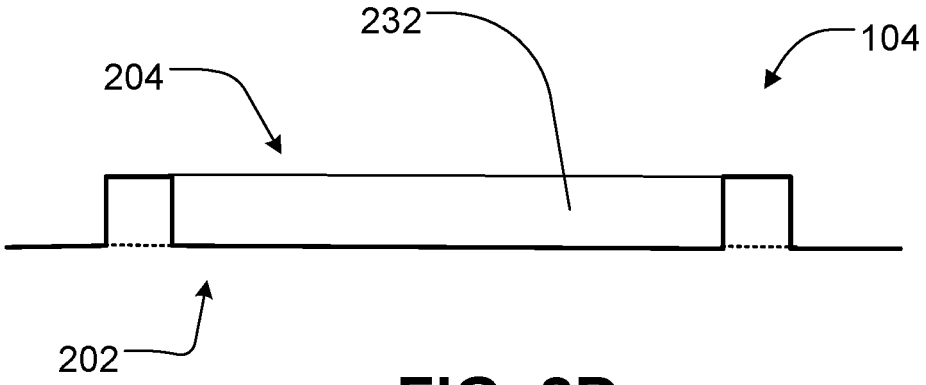
FIG. 2D is a cross-section view of the plastic container of FIG. 2A with the plastic container fully shut.

FIG. 2A is a top view of an example plastic container 104 of the reusable recyclable packing pouch of FIGS. 1A-1B. FIG. 2B is a cross-section view of the plastic container of FIG. 2A along cross section A-A with the plastic container 104 open. FIG. 2C is a cross-section view of the plastic container of FIG. 2A with the plastic container 104 partially shut. FIG. 2D is a cross-section view of the plastic container 104 of FIG. 2A with the plastic container fully shut. Referring to FIG. 2A-2D, the plastic container 104 has a first portion 202 and a second portion 204. When the plastic container 104 is shut, the first portion 202 generally forms the bottom of and the second portion 204 generally forms the top of the container. The first portion has a first shaped region 208. The first shaped region 208 can be rectangular, as shown in FIG. 2A. Alternatively, the first shaped region 208 can be a different geometric shape. For example, the first shaped region can be a square, a circle, a triangle, a hexagon, or irregular. In other words, the first and second portions 202, 204 can be shaped/sized to suit a desired purpose, e.g., to contain various types of monitoring devices 108 or shipping documents. The first shaped region 208 has a first flange 210 that extends around a first perimeter 212 of the first shaped region 208. The first perimeter 212 and a second perimeter 214 define the first shaped region 208. The first shaped region 208 has a top surface 226 different that the first surface 218. The top surface 218 and the first perimeter 212, and the second perimeter 214 define the first shaped region 208.

Referring to FIG. 2B, the first flange 210 extends from the first perimeter 212 to an outer perimeter 236 of the plastic container 104. The first shaped region 208 has a first recessed region 220 defined by the second perimeter 214. The greater height of either an outer surface 222 or an inner surface 224 of the first flange 210 defines the height of the first shaped region 220. The outer surface 222 and the inner surface 224 are connected by the top surface 226. The inner surface 224 extends around the second perimeter 214 to define a first recessed region 220. The first recessed region 220 is sized to hold the monitoring device 108 and/or a packing slip.

The plastic container 104 has a second portion 204 sized to mate with the first shaped region 208. The second portion 204 has a second recessed region 228 extending from a second surface 230 at a third perimeter 240 such as to define a void 232. The void 232 can also be referred to as a space. The void 232 is between facing surfaces: the first surface 218 of the first portion 202 and the second surface 230 of the second portion 204. The second portion 204 has a second flange 238 corresponding to the second surface 230. The first portion 202 and the second portion 204 are placed together by mating the first flange 210 and the second flange 238 to form the void 232. The void 232 holds the monitoring device 108. The first portion 202 and the second portion 204 snap together to form the protective shell. A hinge 206 can connect the first portion 202 and the second portion 204. For example, when the first portion 202 and the second portion 204 are formed from a single piece of plastic, the hinge 206 can be a weaker portion of the plastic allowing the first portion 202 and the second portion 204 to articulate about the hinge 206. For example, the hinge 206 can be a thinner portion of plastic as compared to the first portion 202 and the second portion 204. Alternatively, the hinge 206 can be a perforated portion of plastic between the first portion 202 and the second portion 204. Referring to FIG. 2B, the first portion 202 and the second portion 204 articulate about the hinge 206 like a clam-shell in the direction of arrow 234. Referring to FIG. 2C, the second portion 204 closes onto the first portion 202. Referring to FIG. 2D, the second portion 204 fully closes to snap onto the first portion 202. Alternatively, the first portion 202 and the second portion 204 can be separate pieces. For example, the second portion 204 can be situated to close onto the first portion 202, then forced together to snap shut.

The plastic container 104 can include a transparent portion. The transparent portion allows transmission of light into the plastic container 104 and a person or machine to view and scan the contents (the monitoring device 118 and/or the packing slip). The transparent portion permits scanning of the machine readable code 110 (as shown in FIG. 1) on the monitoring device 18 and/or the packing slip contained within the plastic container 104. In some cases, the entire plastic container 108 is transparent. Additionally, the condition of the shipping envelope as shown by the monitoring device 108 described above can be observed by the person.

The plastic container 104 is constructed from a plastic material. For example, the plastic container 104 can be polyethylene terephthalate, polyethylene, or polypropylene. The plastic container 104 is constructed from a recyclable material. The plastic material of the plastic container 104 provides protection to the contents of the plastic container 104 from scuffing, shock/vibration and compression from all directions and protection to the machine readable code 110 on the monitoring device 108.

Figure 3A:
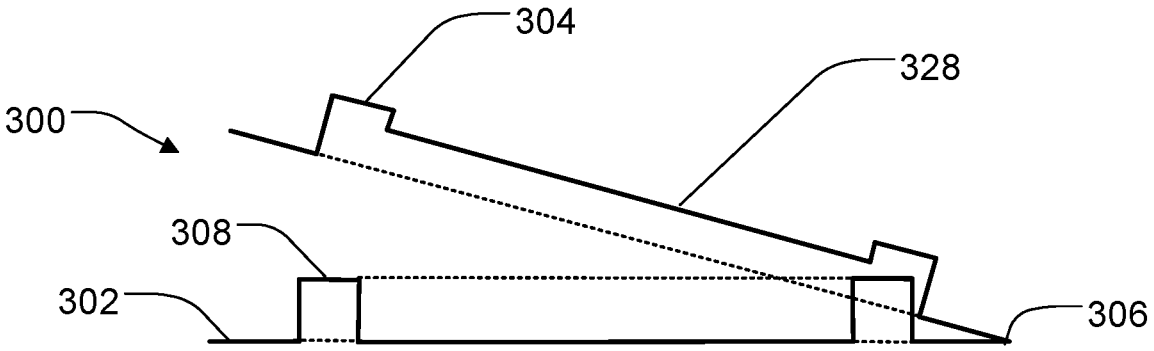
FIG. 3A is a cross-section view of a first embodiment of the plastic container with the plastic container partially open.
Figure 3B:
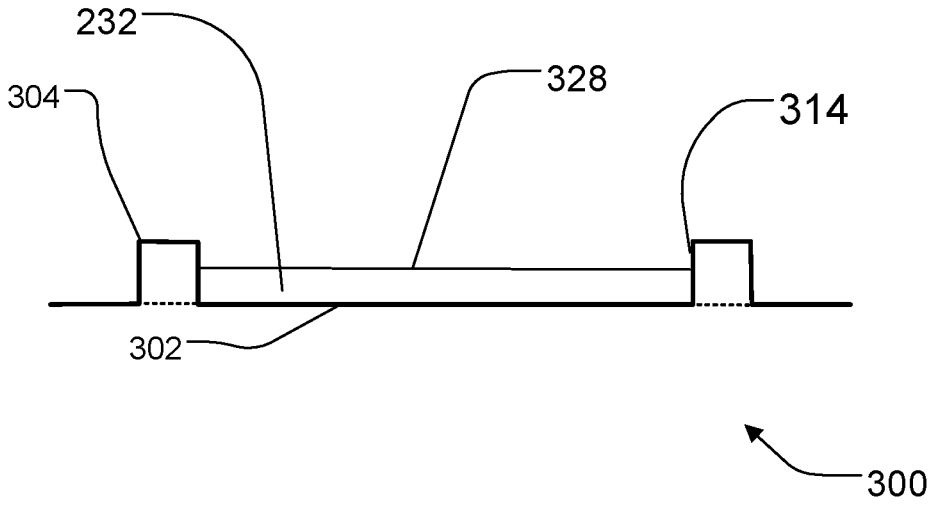
FIG. 3B is a cross-section view of the first embodiment of the plastic container of FIG. 3A with the plastic container fully shut.

FIG. 3A is a cross-section view of another embodiment of the plastic container with the plastic container partially open. FIG. 3B is a cross-section view of the embodiment of the plastic container of FIG. 3A with the plastic container fully shut. Referring to FIGS. 3A and 3B, a plastic container 300 generally similar to the plastic container 104 is shown. The plastic container 300 has a first portion 302 (e.g., bottom portion) substantially similar to the first portion 202 discussed earlier. The plastic container 300 has a second portion 304 (e.g., top portion) generally similar to the second portion 204 discussed earlier. The second portion 304 has a partially recessed region 328 similar to the second non-recessed region 228. The partially recessed region 328 spans the area corresponding to the similar area of the first shaped region 208 inside the second perimeter 214 shown in FIG. 2A. The plastic container 300 includes a hinge 306 coupling the first portion 302 and the second portion 304.

Figure 4A:
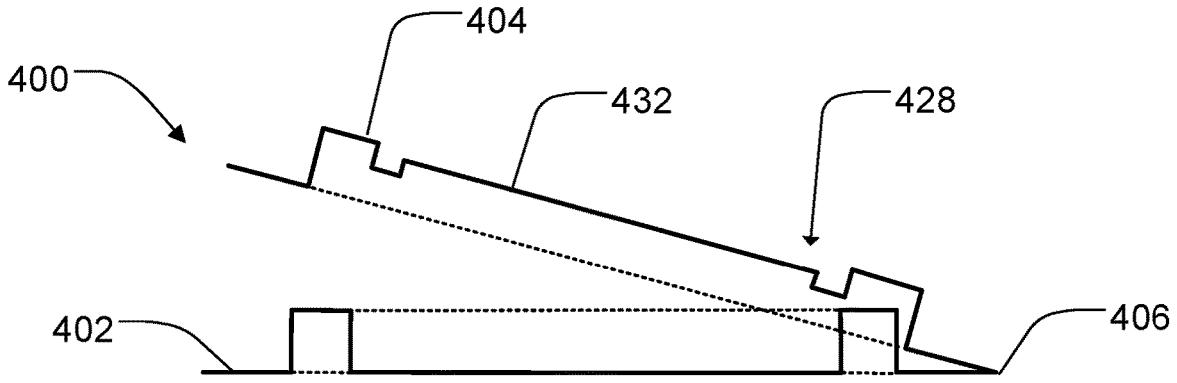
FIG. 4A is a cross-section view of a second embodiment of the plastic container with the plastic container partially open.
Figure 4B:
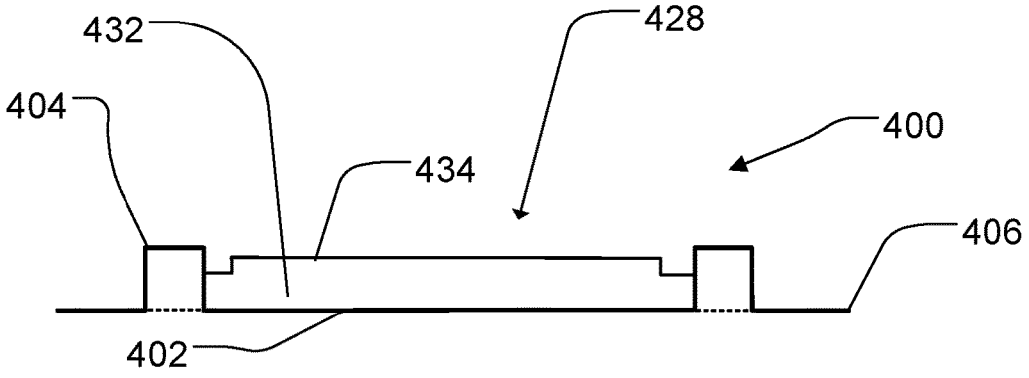
FIG. 4B is a cross-section view of the second embodiment of the plastic container of FIG. 4A with the plastic container fully shut.

FIG. 4A is a cross-section view of a second embodiment of the plastic container with the plastic container partially open. FIG. 4B is a cross-section view of the second embodiment of the plastic container of FIG. 4A with the plastic container fully shut. Referring to FIGS. 4A and 4B, a plastic container 400 generally similar to the plastic container 104 is shown. The plastic container 400 has a first portion 402 (e.g., bottom portion) substantially similar to the first portion 202 discussed earlier. The plastic container 400 has a second portion 404 (e.g., top portion) generally similar to the second portion 204 discussed earlier. The second portion 404 has a partially recessed region 428 similar to the second recessed region 328. The partially recessed region 428 spans a portion of the area similar to the area of the first shaped region 208 inside the second perimeter 214 shown in FIG. 2A. The partially recessed region 428 can appear as a bulge 434 in the second portion 404. The plastic container 400 includes a hinge 406 coupling the first portion 402 and the second portion 404. When the second portion 404 is shut on the first portion 402, a void 432 is defined in the space between the second portion 404 and the first portion 402.

Figure 5A:
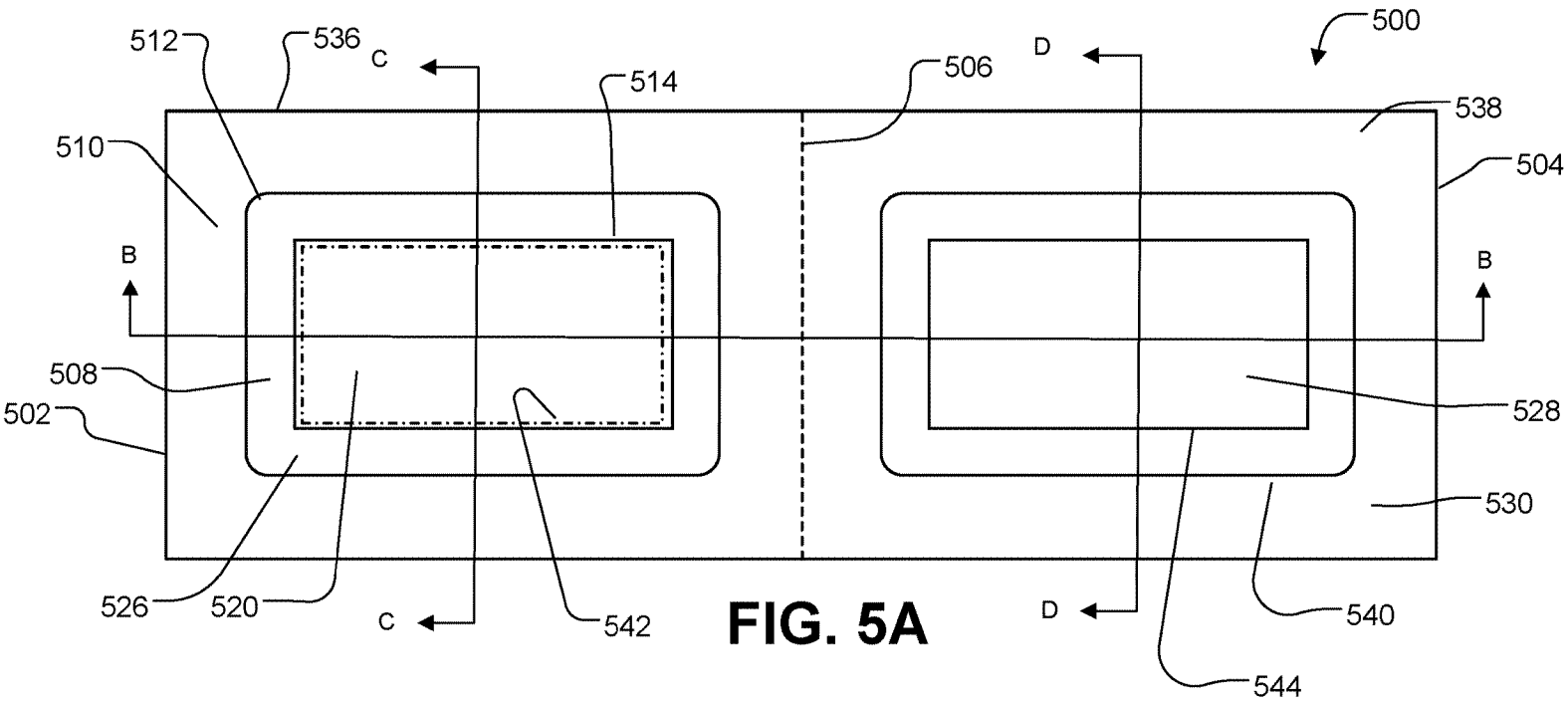
FIG. 5A is a top view of a third alternative plastic container of the reusable recyclable packing pouch of FIG. 1.
Figure 5B:
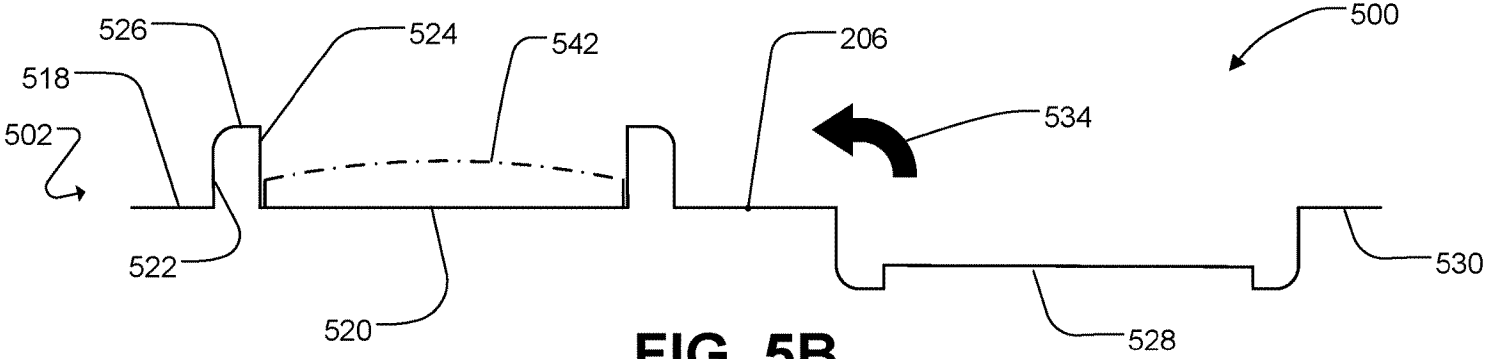
FIG. 5B is a cross-section view of the third alternative plastic container of FIG. 5A along cross section B-B with the plastic container open.
Figure 5C:
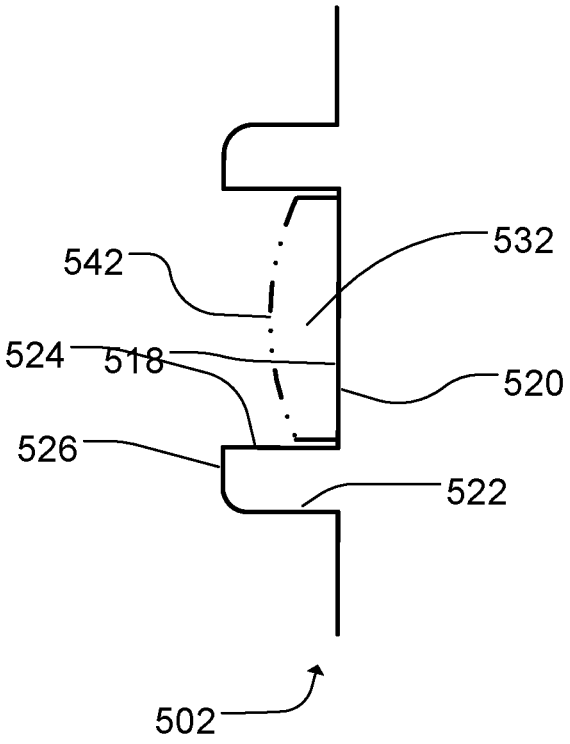
FIG. 5C is a cross-section view of the third alternative plastic container of FIG. 5A along cross section C-C with the plastic container open.
Figure 5D:
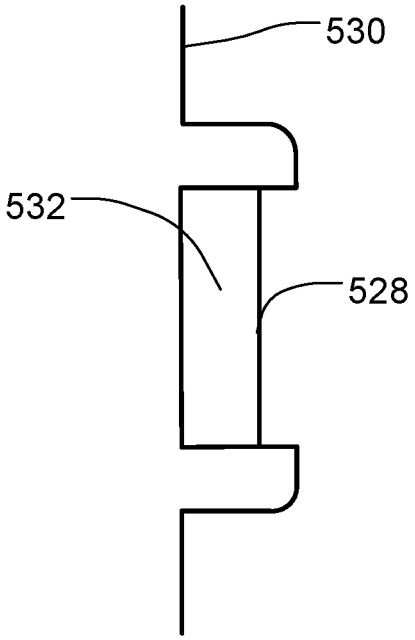
FIG. 5D is a cross-section view of the third alternative plastic container of FIG. 5A along cross section D-D with the plastic container open.

FIG. 5A is a top view of a third alternative plastic container of the reusable recyclable packing pouch of FIG. 1. FIG. 5B is a cross-section view of the third alternative plastic container of FIG. 5A along cross section B-B with the plastic container open. FIG. 5C is a cross-section view of the third alternative plastic container of FIG. 5A with the plastic container open along cross section C-C. FIG. 5D is a cross-section view of the third alternative plastic container of FIG. 5A along cross section D-D with the plastic container open. Referring to FIG. 5A-5D, the third alterative plastic container 500 has a first portion 502 (e.g., bottom portion) and a second portion 504 (e.g., top portion). The first portion 502 has a first shaped region 508. The first shaped region 508 can be rectangular, as shown in FIG. 5A. Alternatively, the first shaped region 508 can be a different geometric shape. For example, the first shaped region 508 can be a square, a circle, a triangle, a hexagon, or irregular. In other words, the first and second portions 502, 504 can be shaped/sized to suit a desired purpose, e.g., to contain various types of monitoring devices or shipping documents. The first shaped region 508 has a first flange 510 that extends around a first perimeter 512 of the first shaped region 508. The first perimeter 512 and a second perimeter 514 define the first shaped region 508. The first shaped region 508 has a top surface 526 different that the first surface 518. The top surface 518 and the first perimeter 512, and the second perimeter 514 define the first shaped region 508. The first recessed region 520 includes and is sized to contain a resealable pouch 542. The resealable pouch 542 provides an additional barrier of protection for shipping documents or the monitoring device 108.

Referring to FIGS. 5B, 5C and 5D, the first flange 510 extends from the first perimeter 512 to an outer perimeter 536 of the plastic container 500. The first shaped region 508 has a first recessed region 520 defined by the second perimeter 514. The greater height of either an outer surface 522 or an inner surface 524 of the first flange 510 defines the height of the first shaped region 520. The outer surface 522 and the inner surface 524 are connected by the top surface 526. The inner surface 524 extends around the second perimeter 514 to define a first recessed region 520. The first recessed region 520 is sized to hold the monitoring device 108 and/or a packing slip.

The plastic container 500 has a second portion 504 sized to mate with the first shaped region 508. The second portion 504 has a second recessed region 528 extending from a second surface 530 at a third perimeter 540 such as to define a void 532. The second recessed region 528 can be further defined by a fourth perimeter 544, to make the second recessed region 528 partially recessed, as shown in FIG. 5B, and generally similar to the partially recessed plastic container 300. The void 532 can also be referred to as a space. The void 532 is between facing surfaces: the first surface 518 of the first portion 502 and the second surface 530 of the second portion 504. The second portion 504 has a second flange 538 corresponding to the second surface 530. The first portion 502 and the second portion 504 are placed together by mating the first flange 510 and the second flange 538 to form the void 532. The void 532 holds the monitoring device 108. The first portion 502 and the second portion 504 snap together to form the protective shell.

A hinge 506 can connect the first portion 502 and the second portion 504. For example, when the first portion 502 and the second portion 504 are formed from a single piece of plastic, the hinge 506 can be a weaker portion of the plastic allowing the first portion 502 and the second portion 504 to articulate about the hinge 506. For example, the hinge 506 can be a thinner portion of plastic as compared to the first portion 502 and the second portion 504. Alternatively, hinge 506 can be a perforated portion of plastic between the first portion 502 and the second portion 504. Referring to FIG. 5B, the first portion 502 and the second portion 504 articulate about the hinge 506 like a clam-shell in the direction of arrow 534.

Figure 6B:
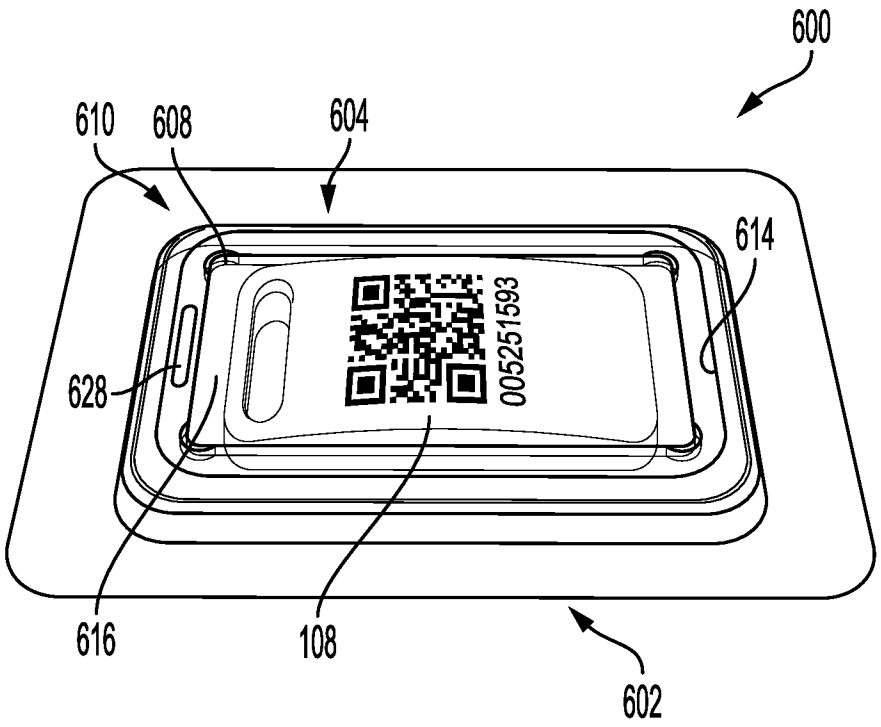
FIG. 6B is a perspective view of the fourth alternative plastic container of the reusable recyclable packing pouch of FIG. 6A.
Figure 6A:
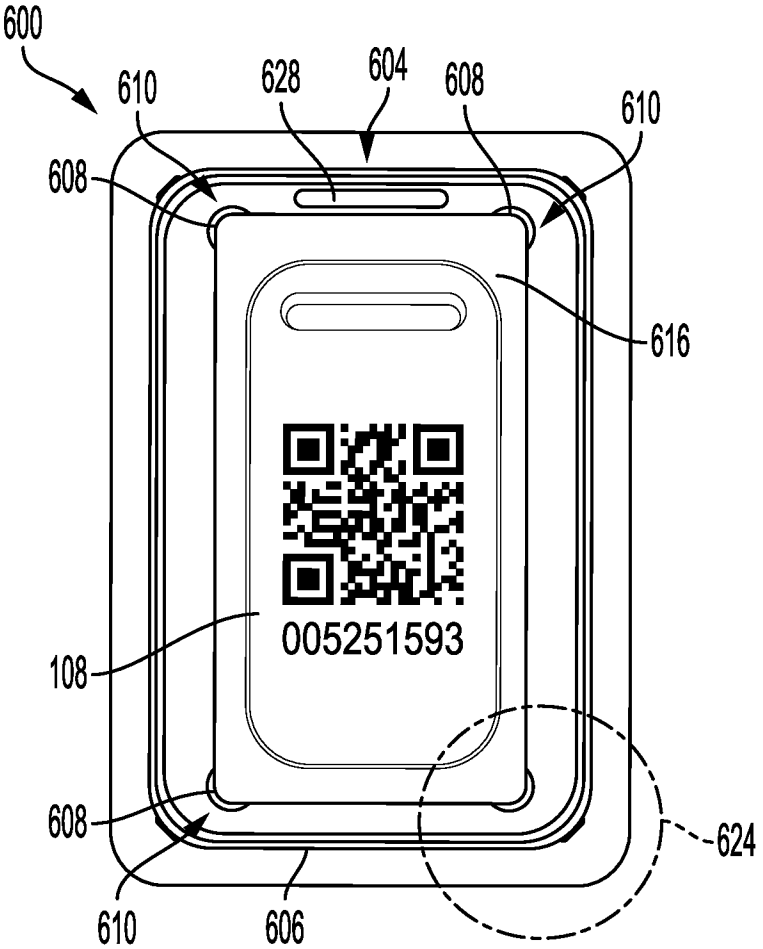
FIG. 6A is a top view of a fourth alternative plastic container of the reusable recyclable packing pouch of FIG. 1.
Figure 6C:
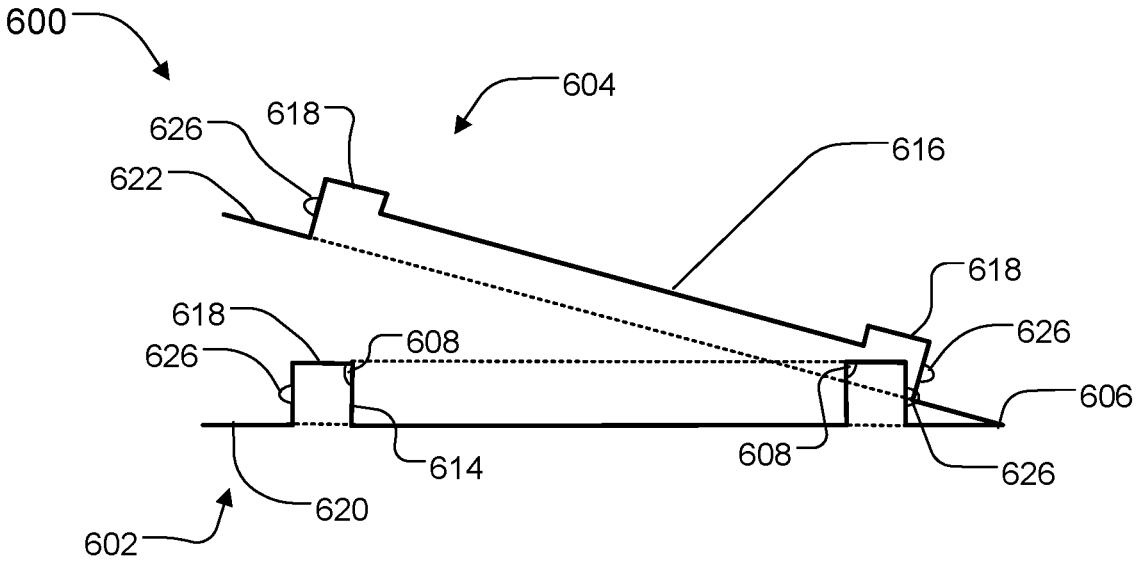
FIG. 6C is a cross-section view of the fourth embodiment of the plastic container of FIG. 6A with the plastic container partially open.
Figure 6D:
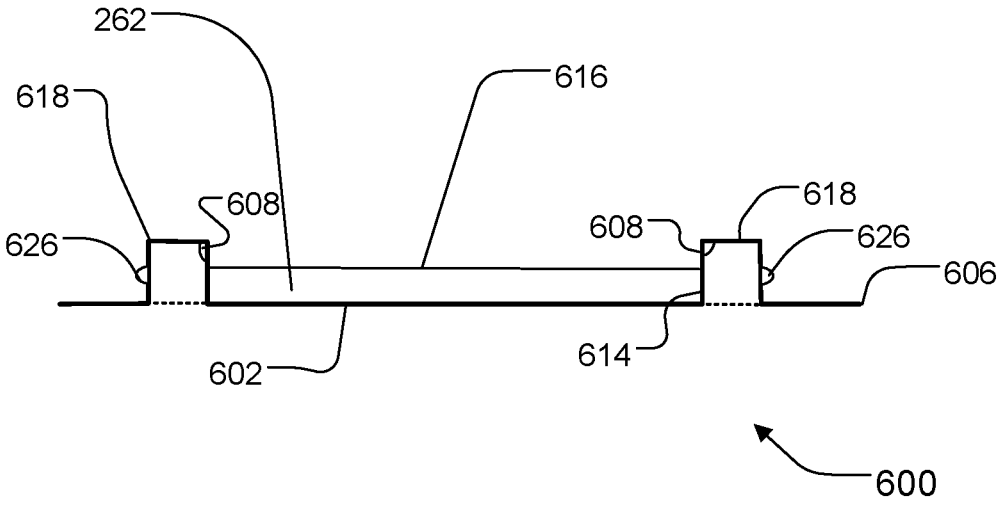
FIG. 6D is a cross-section view of the fourth embodiment of the plastic container of FIG. 6A with the plastic container fully shut.
Figure 6E:
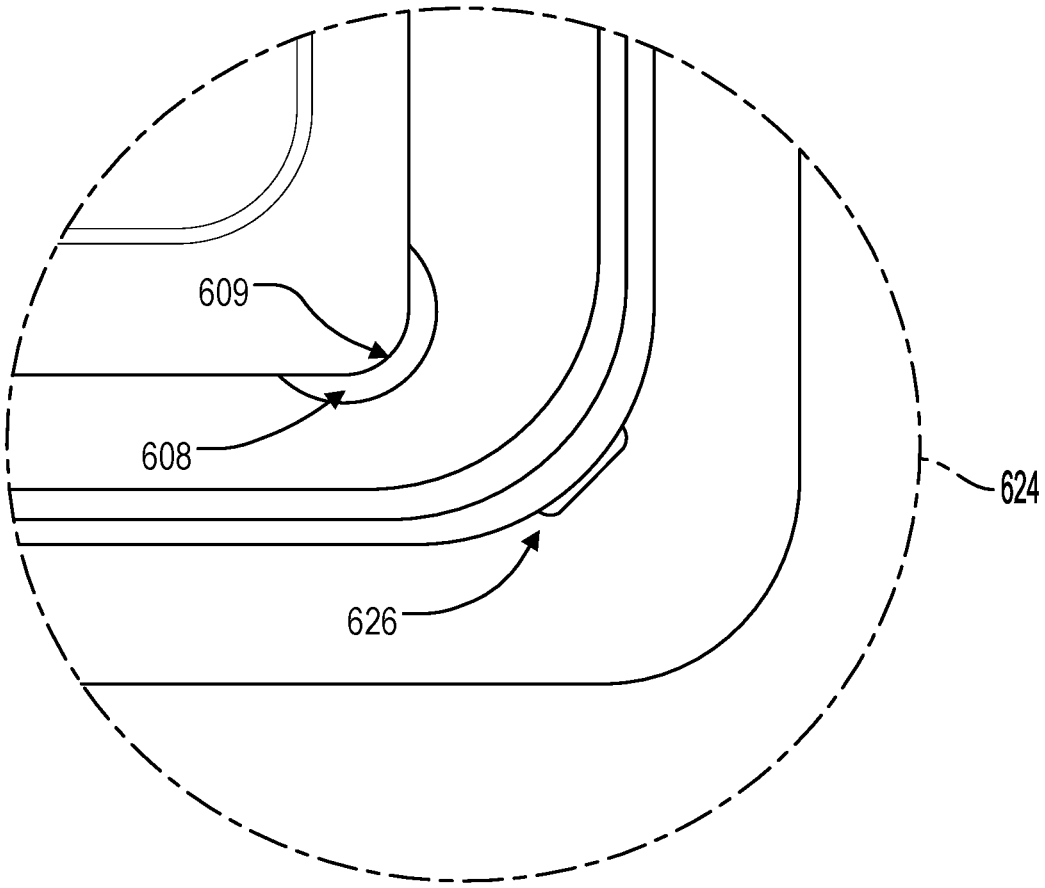
FIG. 6E is a detailed diagram of a corner of the plastic container.
Figure 6F:
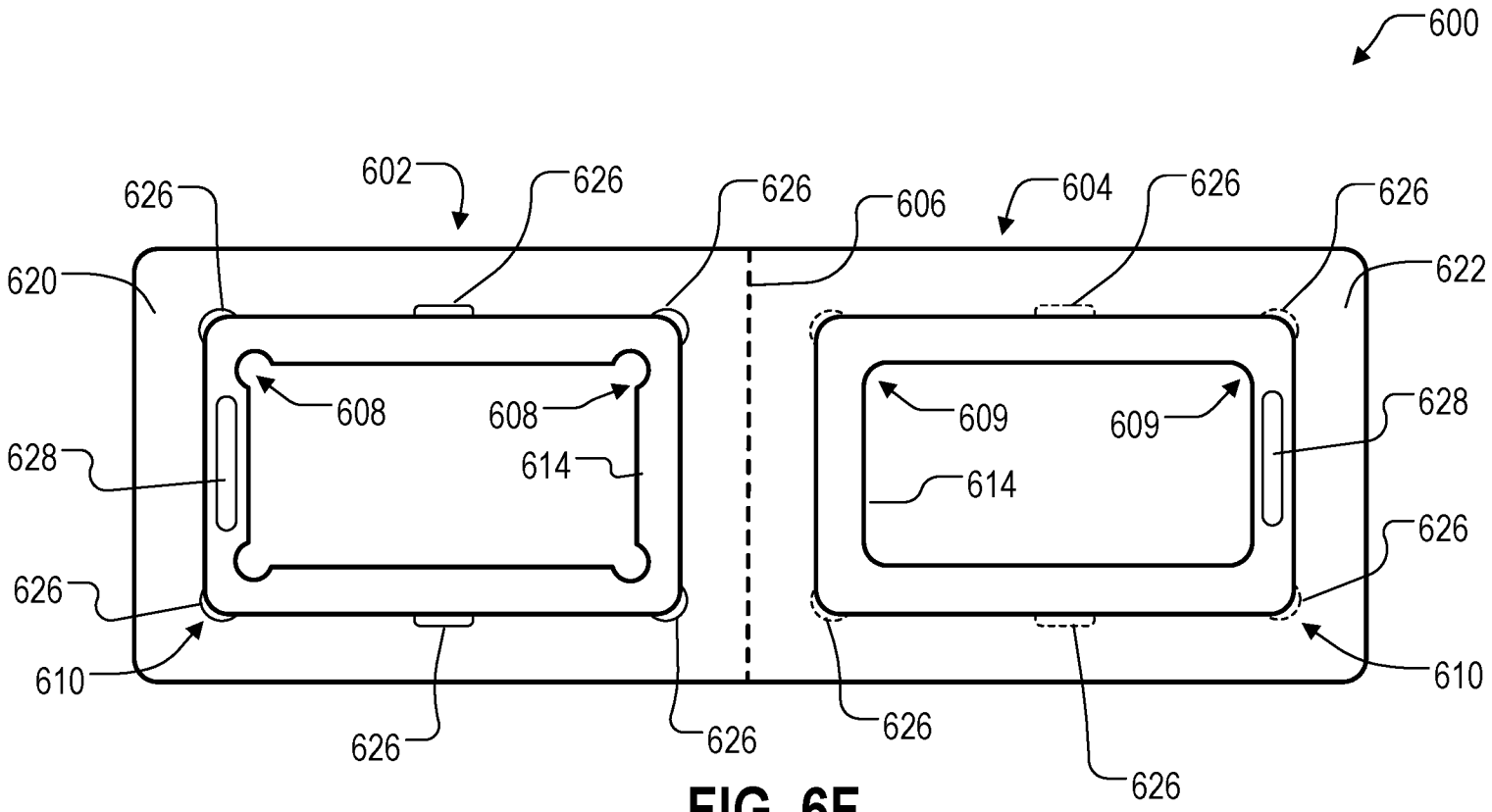
FIGS. 6F and 6G are plan views of the plastic container of with the plastic container open.
Figure 6G:
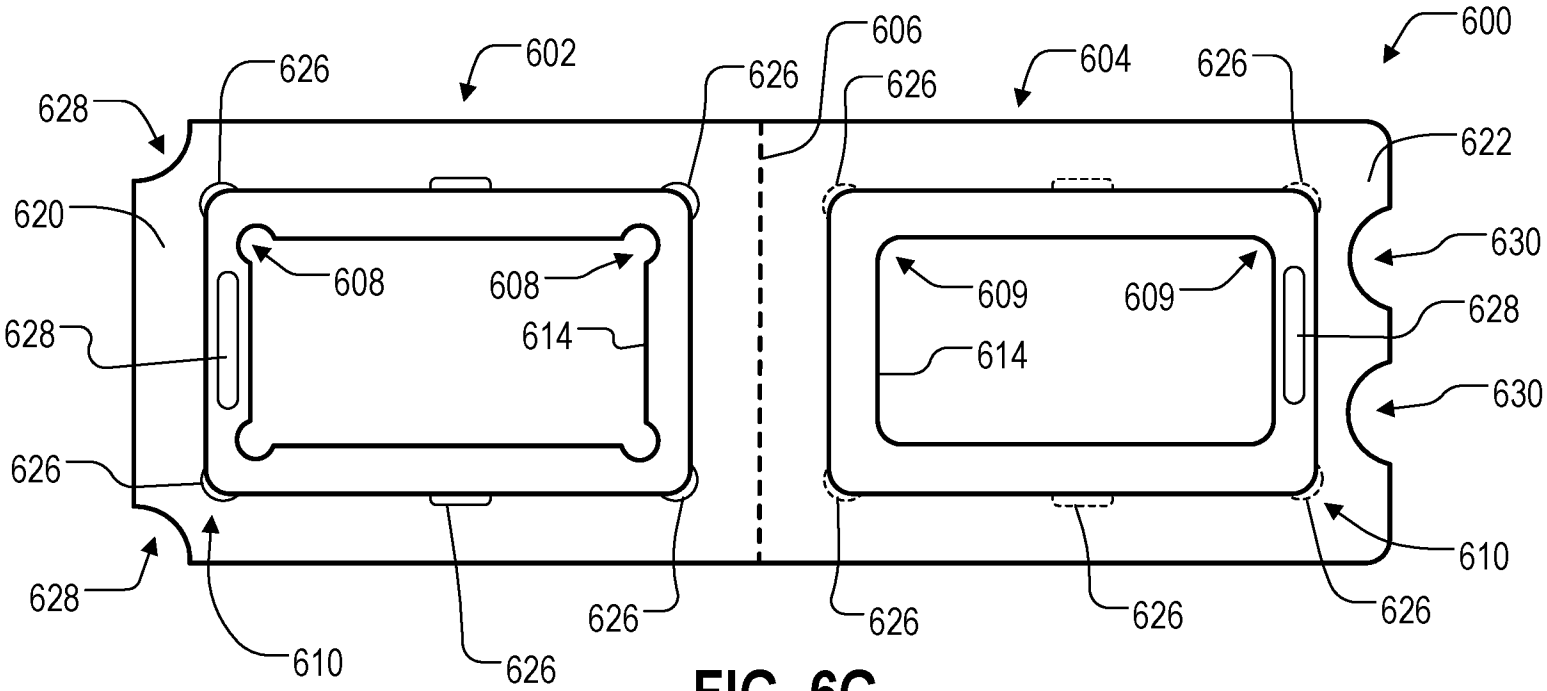

FIG. 6A is a top view of a fourth alternative plastic container of the reusable recyclable packing pouch of FIG. 1. FIG. 6B is a perspective view of the fourth alternative plastic container of the reusable recyclable packing pouch of FIG. 6A. FIG. 6C is a cross-section view of the fourth embodiment of the plastic container of FIG. 6A with the plastic container partially open. FIG. 6D is a cross-section view of the fourth embodiment of the plastic container of FIG. 6A with the plastic container fully shut. FIG. 6E is a detailed diagram 624 of a corner of the plastic container. FIGS. 6F and 6G are plan views of the plastic container of with the plastic container open.

Referring to FIGS. 6A-6G, the plastic container 600 has a first portion 602 (e.g., a bottom portion) generally similar to the first portion 202 discussed earlier. The plastic container 600 has a second portion 604 (e.g., a top portion) generally similar to the second portion 204 discussed earlier. The second portion 604 has a partially recessed region 616 similar to the second recessed region 328. The partially recessed region 616 spans the area corresponding to the similar area of the first shaped region 208 inside a second perimeter 614 (similar to the second perimeter 214 shown in FIG. 2A). The partially recessed region 616 is bordered by a raised region 618 (generally similar to the second portion 304 previously described). The plastic container 600 includes a hinge 606 coupling the first portion 602 and the second portion 604.

In some implementations, the plastic container 600 includes a hole 628 extending through the raise region 618 of both portions (the first portion 602 and the second portion 604) at one end. For example, the hole 628 can be used to pass fasteners, e.g., zip ties, string, cord, etc. through the plastic container 600 to attach the plastic container 600 to shipping package without using the paperboard jacket 700.

The plastic container 600, optionally, includes projections 626 extending outward from respective sidewalls of the first portion 602 and/or the second portion 604. The projections 626 can be located at the outer corners 610 of the first portion 602 and/or the second portion 604 (e.g., as shown in the detail diagram 624 in FIG. 6E). In some implementations, the projections 626 can be located along the sides (e.g., as shown in FIGS. 6F and 6G). In some implementations, the projections 626 can be located both at the corners and along the sides. The projections 626 can be formed into the sidewalls as either a molded feature or pressed in to the sidewalls after molding. Corresponding projections 626 on the first and second portions (e.g., top and bottom) of the container 600 are formed at corresponding heights such that they interlock with each other (as depicted in FIG. 6E) when the container 600 is fully closed. In some implementations, the projections 626 are formed at a height above the respective flanges 620, 622 that generally corresponds with a thickness of the paper board jacket, as described in more detail below with reference to FIGS. 7E-7G.

The plastic container 600, optionally, includes concave regions 608 (circular shaped features) in corners 610 of the interior perimeter of the first portion 602. In some cases, the concave regions 608 can increase a coupling force between the first portion 602 and the second portion 604. In other cases, the concave regions 608 in the corners 610 can strengthen and support the structural rigidity of the plastic container 600. In some cases, interior corners 609 of the second portion 604 extend into the corresponding concave regions 608 of the first portion 602 when the container 604 is closed, improving lock-up between the first portion 602 and the second portion 604.

In some contexts, flanges 620 and 622 can be referred to as a singular flange when mated together with the plastic container 600 in a closed position. For example, when in the closed position the flanges 620 and 622 have aligned edges such that they form a singular annular flange surrounding the central container region of the plastic container 600 formed by the joined raised regions 618 of the first and second portions 602 and 604.

In some implementations, the flanges 620 and 622 include cutouts 628 and 630 (shown in FIG. 6G). The cutouts 628 on flange 620 are offset from the cutouts 630 on flange 622. The cutouts 628, 630 allow a user to more easily open the plastic container 600. For instance, a user can grasp flange 620 through cutout 630 and separately grasp flange 622 through cutout 628 open the container 600.

Figure 7B:
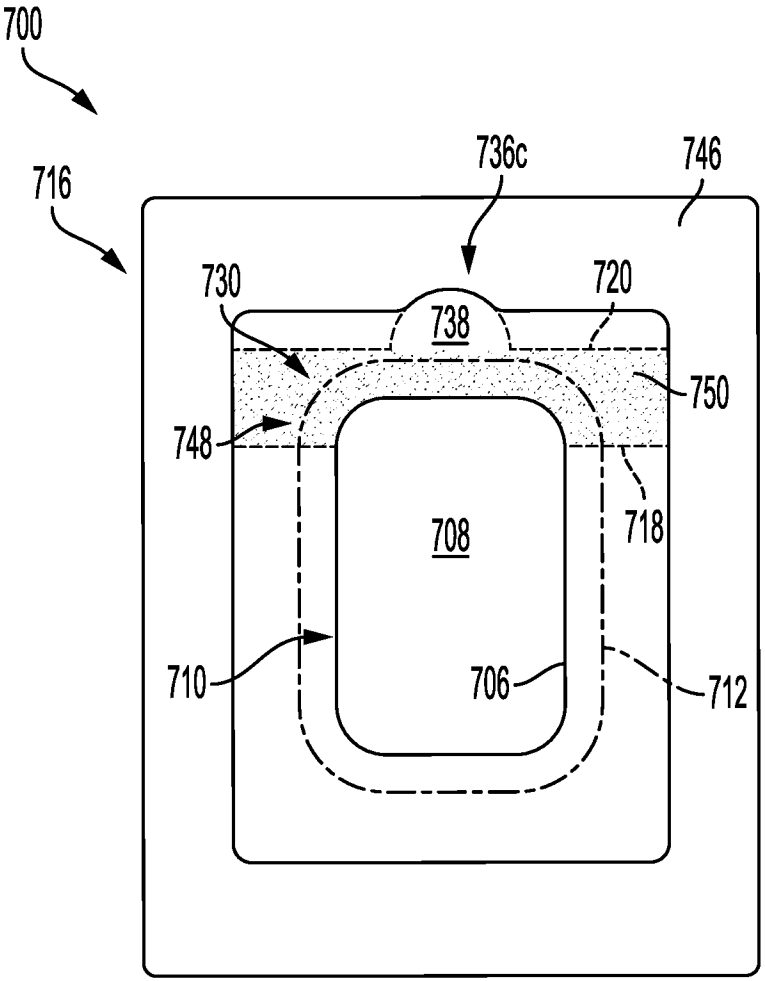
FIG. 7B is a rear view of the paperboard jacket assembly of the reusable recyclable packing pouch of FIG. 7A.
Figure 7A:
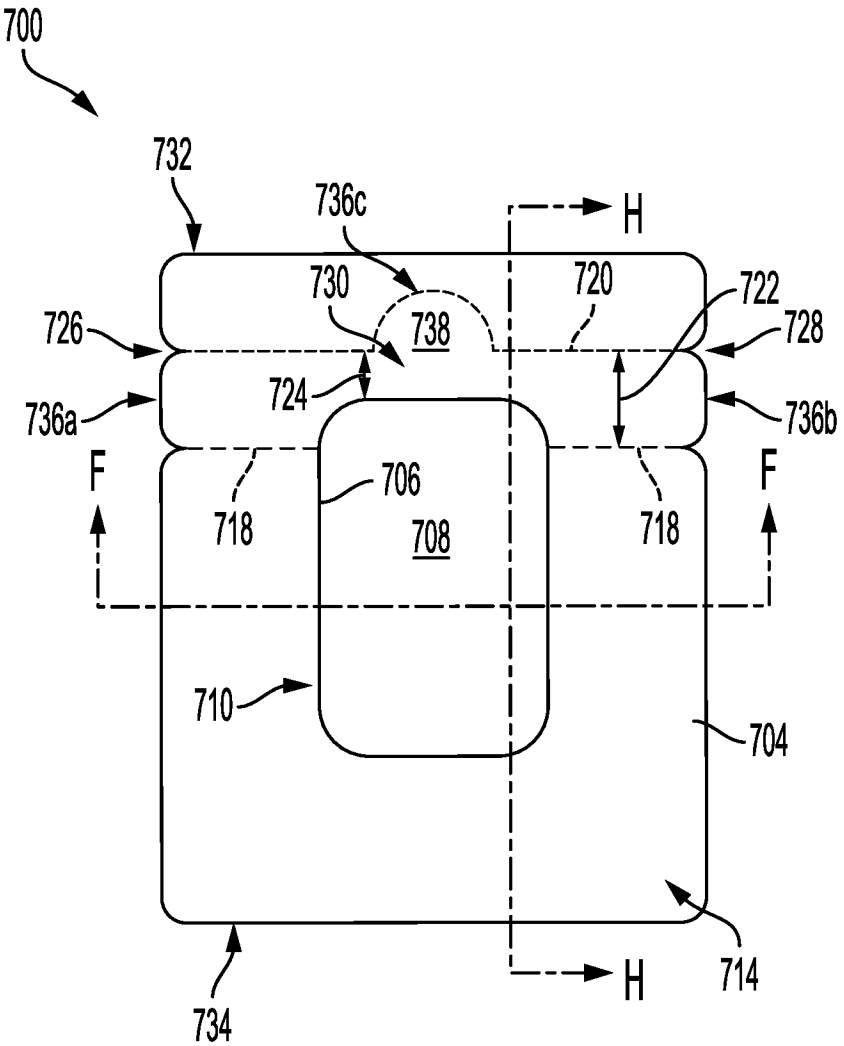
FIG. 7A is a front view of an example paperboard jacket assembly of the reusable recyclable packing pouch of FIG. 1.
Figure 7D:
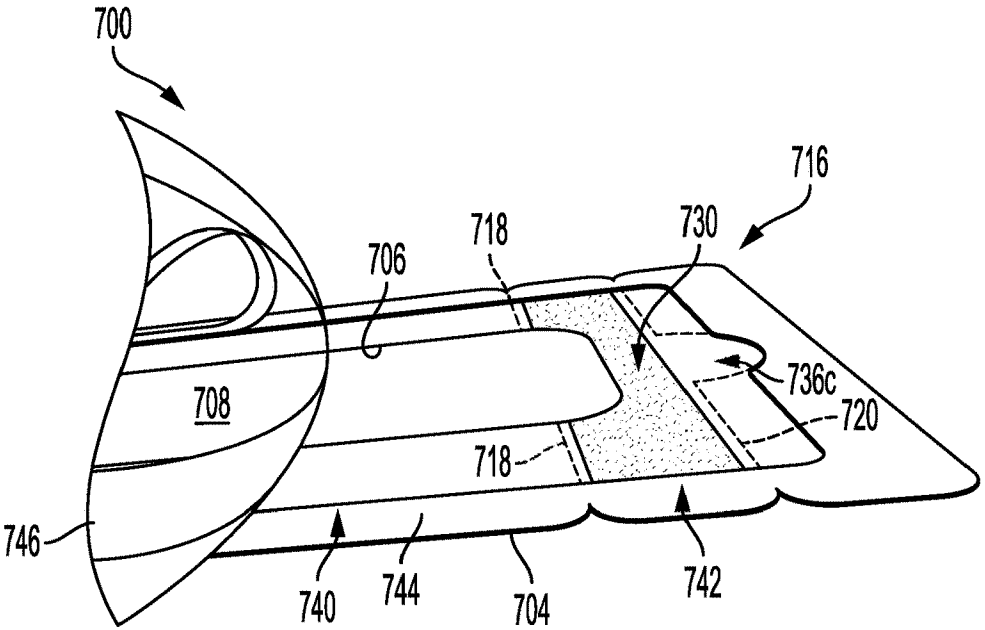
FIG. 7D is a rear perspective view of the paperboard jacket assembly of the reusable recyclable packing pouch of FIG. 7A with the release liner partially removed from an adhesive.
Figure 7C:
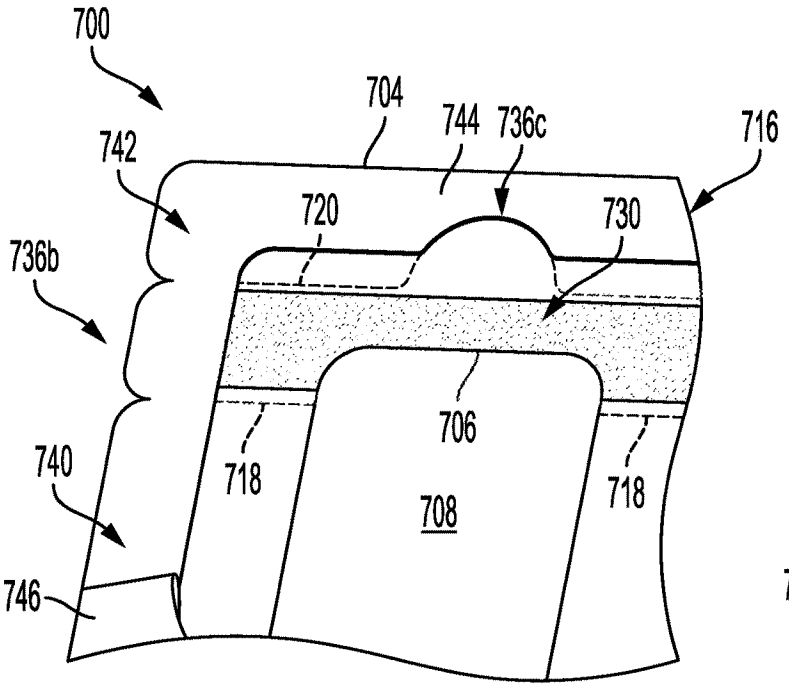
FIG. 7C is another rear view of the paperboard jacket assembly of the reusable recyclable packing pouch of FIG. 7A with the release liner partially removed from an adhesive.
Figure 7E:
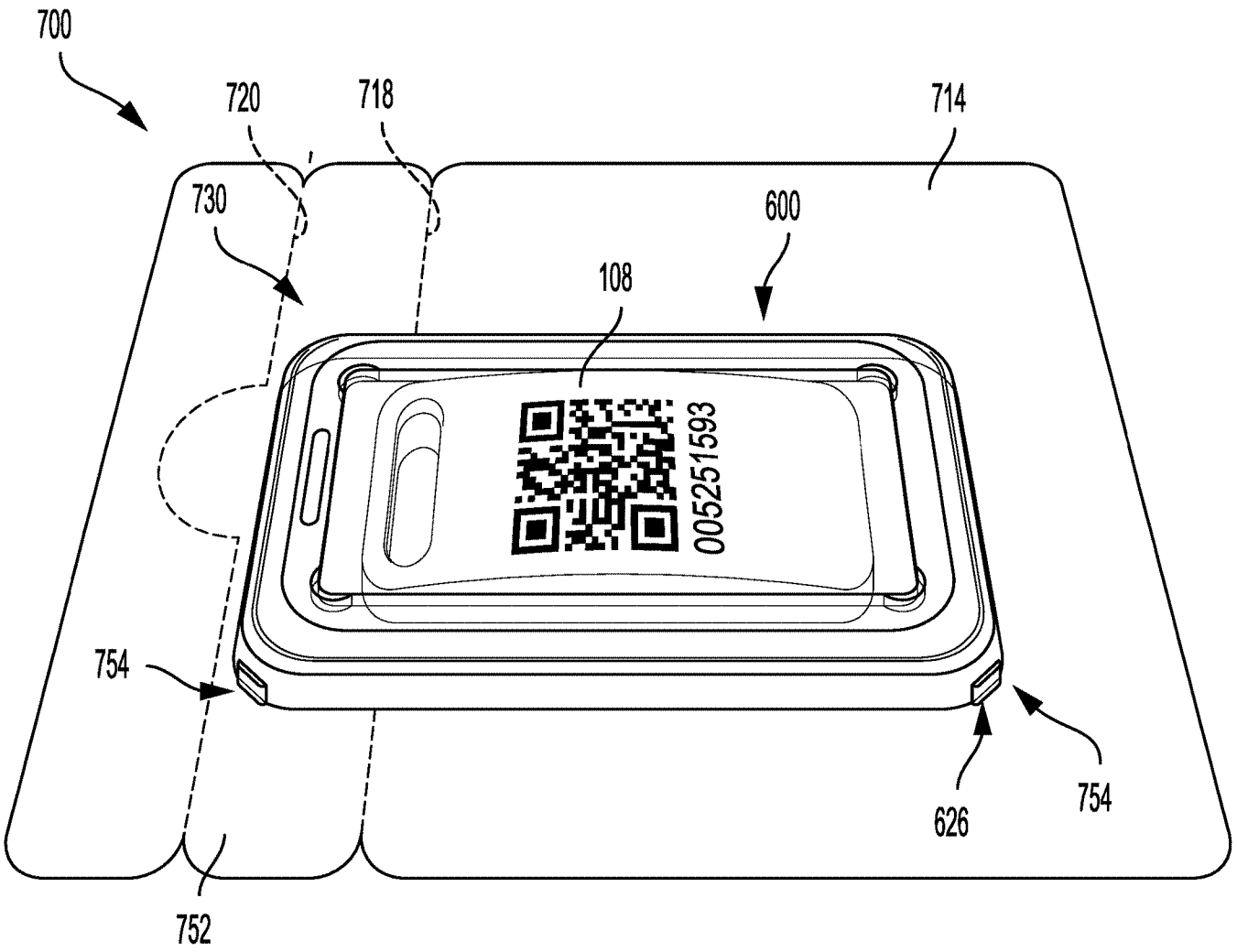
FIG. 7E is a front perspective view of the paperboard jacket of FIG. 7A.
Figure 7F:
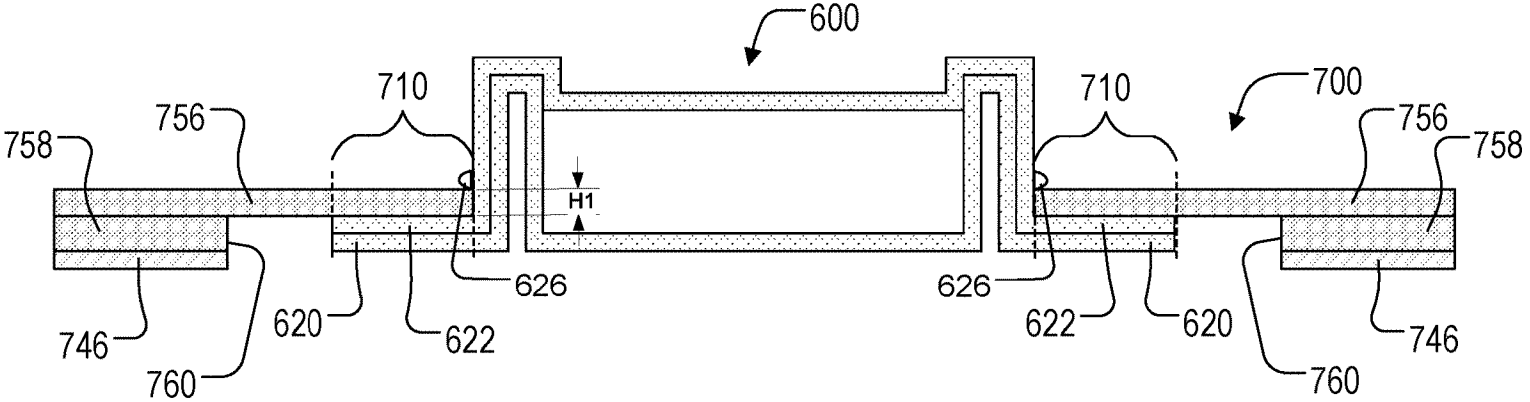
FIG. 7F is a cross-section view of the paperboard jacket of FIG. 7A taken at F-F with the plastic container positioned therein.
Figure 7G:
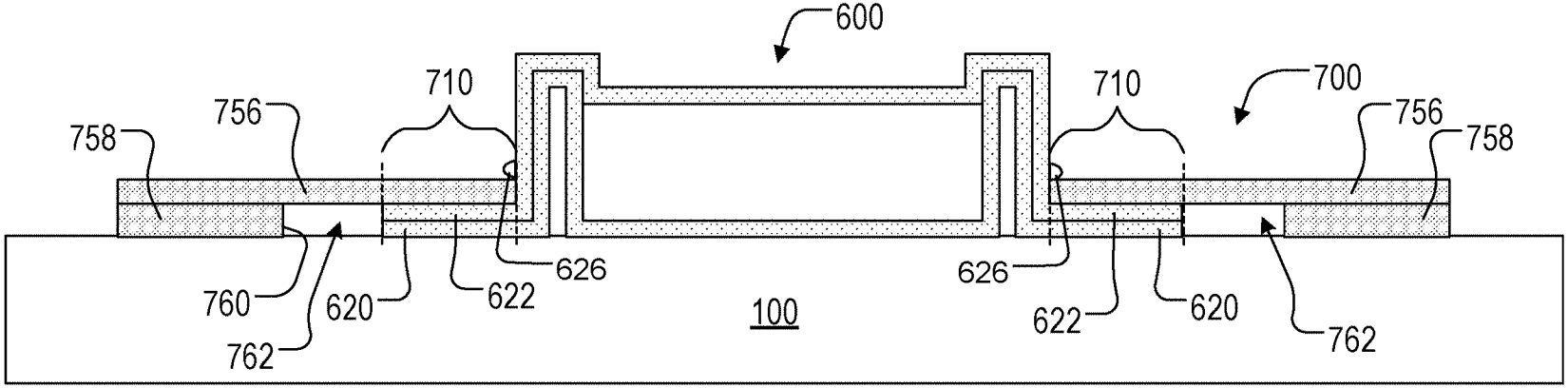
FIG. 7G is a cross-section view of the paperboard jacket of FIG. 7A taken at F-F with the plastic container positioned therein and attached to a shipping container.
Figure 7H:
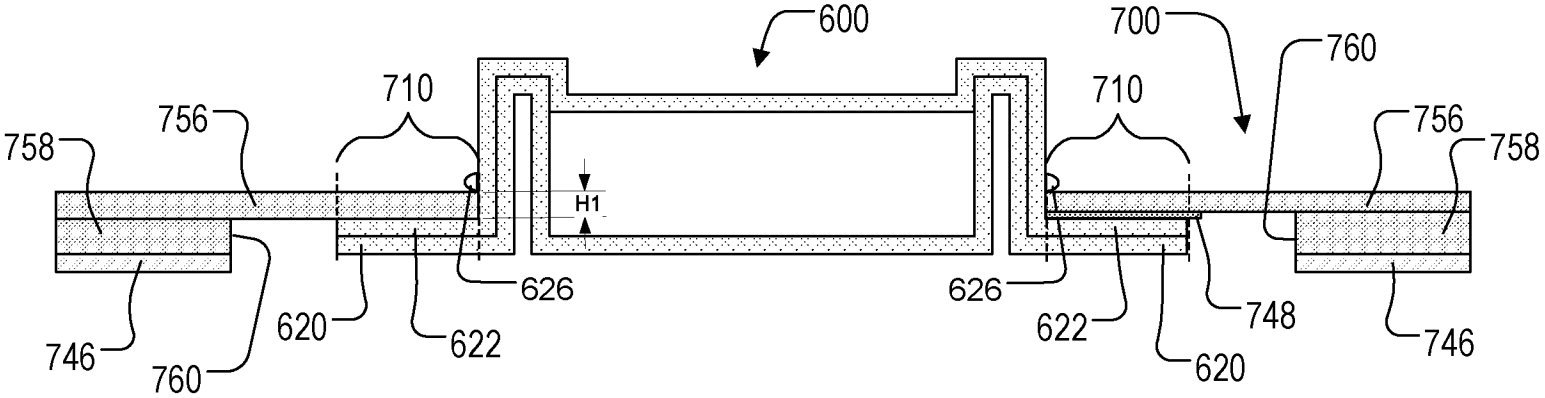
FIG. 7H is a cross-section view of the paperboard jacket of FIG. 7A taken at H-H with the plastic container positioned therein.

FIG. 7A is a front view of an example paperboard jacket assembly of the reusable recyclable packing pouch of FIG. 1. FIG. 7B is a rear view of the paperboard jacket assembly of the reusable recyclable packing pouch of FIG. 7A. FIG. 7C is another rear view of the paperboard jacket assembly of the reusable recyclable packing pouch of FIG. 7A with the release liner partially removed from an adhesive. FIG. 7D is a rear perspective view of the paperboard jacket assembly of the reusable recyclable packing pouch of FIG. 7A with the release liner partially removed from an adhesive. FIG. 7E is a front perspective view of the paperboard jacket of FIG. 7A. FIG. 7F is a cross-section view of the paperboard jacket of FIG. 7A taken at F-F with the plastic container positioned therein. FIG. 7G is a cross-section view of the paperboard jacket of FIG. 7A taken at F-F with the plastic container positioned therein and attached to a shipping container. FIG. 7H is a cross-section view of the paperboard jacket of FIG. 7A taken at H-H with the plastic container positioned therein.

Referring to FIGS. 7A-7H, the paperboard jacket 700 an outer perimeter 704 (also referred to as an outer edge 704) and an inner perimeter 706 (also referred to as an inner edge 706). The inner perimeter 706 defines an aperture 708. The aperture 708 is sized to permit the raised region 618 and the partially recessed region 616 of the plastic container 600 (or any of the other plastic containers described herein) to pass through while flanges 620 and 622, when coupled together, extend past the inner perimeter 706 of the aperture 708. Additionally, the aperture 708 is sized to overlap with the plastic container 600 in an overlap region 710 (shown in FIGS. 7A, 7B, and 7F-H) forming an overlap perimeter 712. The overlap region 710 of paperboard jacket 600 is at a periphery of the aperture 708 between the aperture perimeter 706 and the overlap perimeter 712. The overlap of the first flange 620 coupled to the second flange 622 in the overlap region 710 holds the plastic container 600 within the paperboard jacket 700 when the paperboard jacket is attached to a shipping package 100.

The paperboard jacket 700 can be made from paper, cardboard, or similar materials. Alternatively, in some implementations, the paperboard jacket 700 can be made from plastics or laminates. The paperboard jacket 700 can be made from a combination of multiple materials such both paper and plastics. In some implementations, the paperboard jacket 700 is a 2-ply corrugated cardboard.

The paperboard jacket 700 has a first surface 714. The first surface 714, when the paperboard jacket 700 is affixed to the shipping package 100, is away from the package 100 and toward the person (i.e., the top or front surface). Referring to FIGS. 7A-7C, the paperboard jacket 700 also has a second surface 716 opposite the first surface 714. The second surface 716, when the paperboard jacket assembly 700 is affixed to the shipping package 100, is toward the package and away from the person.

In some implementations, the paperboard jacket 700 is made of two paperboard layers. For example, as shown in the cross-section views depicted in FIGS. 7F-7H, the paperboard jacket 700 can include a top layer 756 and a bottom layer 758. The bottom layer 758 can generally have the same outer perimeter as the top layer 756, but with an inner perimeter 760 that is offset from the aperture perimeter 706 (inner perimeter) of the top layer 756. In other words, the bottom layer 758 can define a larger aperture than the top layer 756. The inner perimeter 760 of the bottom layer 758 is generally outside the overlap perimeter 712 such that it does not intersect with the flanges 620 and 622 of the plastic container 600, when the plastic container 600 is positioned within the aperture 708. Stated differently, the inner perimeter 760 of the bottom layer 758 is sized such that the bottom layer 758 is adjacent to or aligned with the flanges 620 and 622 and does not overlap them (e.g., as shown in the cross-section views of FIGS. 7F-7H). The bottom layer 758 can be formed to have a thickness that corresponds with a total thickness of the flanges 620 and 622 stacked on top of one another. For example, this may improve the overall adhesion of the paperboard jacket 700 to a shipping container by reducing stress on the adhesion joint. For example, the bottom layer 758 creates a cavity 762 between the shipping package 100 and the top layer 756 of the paperboard jacket sized to accommodate the flanges 620 and 622 of the plastic container 600. This promotes a flat adhesion area between the bottom surface of the bottom layer 758 and the surface of the shipping package 100 and reduces stress from a single layer jacket curving around the flanges 620 and 622 to mate with the shipping package 100.

The paperboard jacket 700 has a first set of perforations 718 and a second set of perforations 720. The first set of perforations 718 extends from the inner perimeter 706 defining the aperture 708 to the outer edge 704 of the paperboard jacket 700 on each side of the aperture 708. The first set of perforations 718 is intersected by the aperture 708. The second set of perforations 720 is offset from the first set of perforations 718 by a first distance 722. The second set of perforations 720 is offset from the aperture 708 by a second distance 724. The second set of perforations 720 extends across the paperboard jacket 700. The second set of perforations 720 is not interrupted by the aperture 708. The second set of perforations 720 extend from a first side 726 of the outer edge 704 to a second side 728 opposite the first side 726 of the outer edge 704. The perforations 718, 720 permit tearing and opening of the paperboard jacket 700 to remove the plastic container 600 at the termination of shipping. For instance, because the first set of perforations 718 is intersected by the aperture 708 an opening can be created when the perforated section of the paperboard jacket 700 is torn away that permits the plastic container 600 to be removed without damage.

In some implementations, the first set of perforations 718 is aligned parallel with, but offset from, the second set of perforations 720 as shown in FIG. 7A. In some implementations, the perforations 718 and 720 are orthogonal with the outer edges 704 of the paperboard jacket 700 on opposing sides.

The first and second sets of perforations 718, 720 define a pull tab 730 of the paperboard jacket 700. The pull tab 730 is removable by the user to access and remove the plastic container 600 from the paperboard jacket 700 when the paperboard jacket 700 and the plastic container 600 are attached to the package 100. The pull tab 730 extends between the first side 726 and the second side 728 of the paperboard jacket 700. The pull tab 730 is offset from a third side 732 and a fourth side 734 of the outer edge 704 of the paperboard jacket 700. For instance, because the first set of perforations 718 is intersected by the aperture 708, an opening can be created when the pull tab 730 is torn away that permits the plastic container 600 to be removed without damage.

The pull tab 730 can include pull tab-extensions 736*a-c* extending from a center region 738 of the pull tab 730. The pull tab-extensions 736*a-c* fold responsive to the user applying a force to the pull tab-extensions 736. The pull tab-extensions 736*a-c* can be sized to be moved or folded such that the user can pull the pull tab 730 free of the paperboard jacket 700 (i.e., tearing the pull tab 730 off the package 100 breaking the remaining body of the paperboard jacket 700 between the perforations 718, 720).

Pull tab-extensions 736*a* and 736*b* define and are in contact with a portion of the outer edge 704. In other words, the pull tab-extensions 736*a* and 736*b* can be accessed by the user externally from the paperboard jacket 700.

Pull tab-extension 736*c* extends from the center region 738 of the pull tab 730 internal to the paperboard jacket 700. The pull tab-extension 736*c* extends from the central region 738 of the pull tab 730 proximate a middle location in the interior of the paperboard jacket 700. The pull tab-extension 736*c* extends from the central region 738 of the pull tab 730 extends away from the plastic container 600.

Alternatively, the perforations 718, 720 may not necessarily extend entirely across the paperboard jacket 700. This can be referred to as scoring. The perforations 718, 720 are illustrated in FIG. 7A as extending across the top (e.g., shorter side) of the paperboard jacket 700. In other implementations, the perforations 718, 720 can extend accords the bottom or a side (e.g., longer side) of the paperboard jacket 700 in a similar configuration to that shown. For example, perforation 720 can extend from the top edge of the paperboard jacket 700 to the bottom and parallel to a long edge of the aperture 708, while perforation 718 extends from the top to the bottom of the jacket 700, parallel to perforation 720, but intersected by the aperture 708 along the long side edge of the aperture 708 rather than the top edge of the aperture as depicted.

The pull tab 730 can include a rigid backing 748 attached to a bottom surface 750 of the pull tab 730. The rigid backing 748 provides added rigidity to the pull tab 730 to aid in tearing the pull tab 730 away from the paperboard jacket 700. The rigid backing 748 can be a plastic backing, e.g., a thin layer of plastic adhered to the bottom surface 750 of the pull tab 730 region of the paperboard jacket. The rigid backing 748 can extend along an entire length of the pull tab 730 or a portion thereof. In some implementations, one edge of the rigid backing 748 is adjacent to (e.g., aligned with) one or both of the perforations 718 and 720. For instance, having the rigid backing 748 directly aligned with perforations 718 may promote a clean tear along the perforations 718. In some implementations, (e.g., as depicted in FIG. 7H) a portion of the rigid backing 748, e.g., one or both ends, is sandwiched between the top and bottom layers 756 and 758 of the paperboard jacket 700.

The paperboard jacket 700 has an adhesive coating 740 located on the second surface 716 of the paperboard jacket 700. In implementations that employ two layers (e.g., layers 756 and 758) the adhesive coating 740 is applied to the bottom surface of the bottom layer 758. The adhesive coating 740 is located within a second region 742 of the paperboard jacket 700 that does not overlap with the overlap region 710 of paperboard jacket 700 at a periphery of the aperture 708. The second region 742 is the adhesive region. The adhesive coating 740 affixes the paperboard jacket 700 to the shipping package 100. The adhesive coating 740 can include acrylic adhesives. The adhesive coating 740 can be a permanent adhesive. The permanent adhesive is an adhesive coating 740 that once the bond of the permanent adhesive is broken, the adhesive no longer functions as an adhesive (i.e., a permanent adhesive is not resealable). Moreover, bond strength of a permanent adhesive is typically much higher than that of a resealable adhesive. For example, the bonding strength of a permanent adhesive is much higher than the force required to open the resealable adhesive without failing, separating, or peeling. The adhesive coating 740 has enough adhesion strength to survive the roughness of the shipping environment in order to prevent the paperboard jacket 700 from rubbed open and/or ripping off. The adhesive coating 740 has a first surface (not shown). The first surface is coupled to the paperboard jacket 700. The adhesive coating 740 also has a second surface 744 opposite the first surface to couple to the package 100. The adhesive coating 740 can be a double-sided adhesive tape (i.e., a plastic strip/carrier) with a permanent adhesive.

The paperboard jacket assembly 700 includes a release liner 746. The release liner 746 is attached to the second surface 744 of the adhesive coating 740. The release liner 746 can be formed of a paper material coated with a release agent such as silicone. The release liner 746 would be removed before affixing the reusable recyclable packing pouch paperboard jacket 700 to shipping package 100 via the exposed adhesive coating 740. The release liner 746 is attached to the exterior surface of paperboard jacket 700 to cover and protect the adhesive coating 740 until reusable paperboard jacket 700 is ready to be attached to the shipping package 100.

Referring to FIG. 7E, the paperboard jacket 700 includes an aperture edge 752 on the inner perimeter 706 of the aperture 708 and at corners 754 of the aperture 708. The aperture edge 752 extends generally orthogonally relative from the first surface 714 (the front surface) of the paperboard jacket 700. When the plastic container 600 is placed through the aperture 708 from the second surface 716 (the rear surface) opposite the front surface 714 the aperture edge 752 may engage and contact sidewalls of the plastic container 600.

Referring to FIGS. 7E-7H, the projections 626 of the plastic container 600 can be configured to lock the plastic container in place within the aperture 708 of the paperboard jacket 700. For instance, as discussed above, the projections 626 can be formed at a height ($H_1$ in FIG. 7F) above flange 622 that corresponds with the thickness of the paperboard jacket 700; or in the two layer version, that corresponds with the thickness of the top layer 756 of the paperboard jacket 700. The projections 626 allow the plastic container 600 extend outward slightly over the first surface 714 (front surface) of the paperboard jacket 700. The projection 626 trap the inner edge 706 of the aperture 708 between the projections 626 and flange 622.

Figure 8:
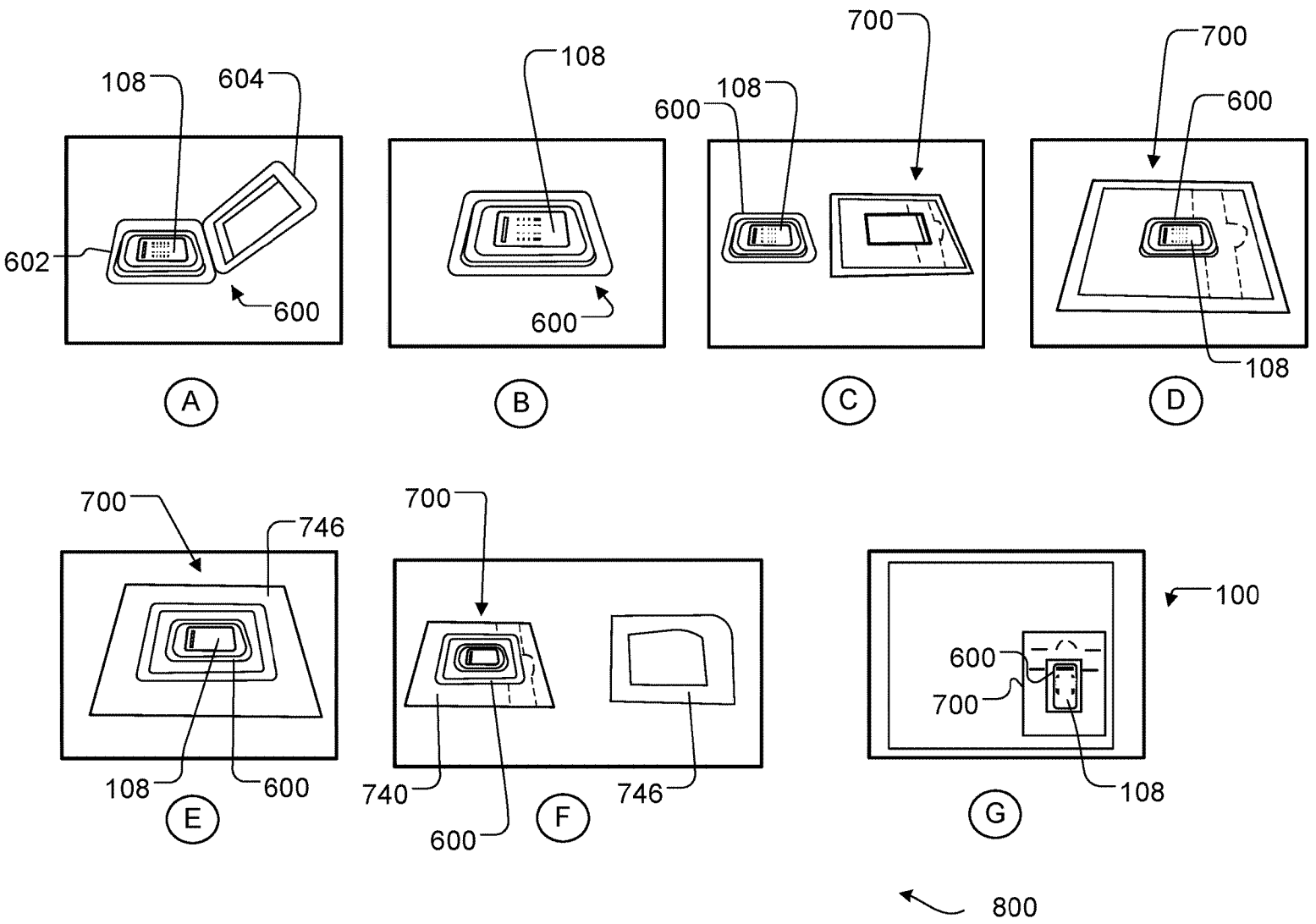
FIGS. 8A-H illustrate steps of a method of assembling the reusable recyclable packing pouch of FIG. 7A.
Figure 8:
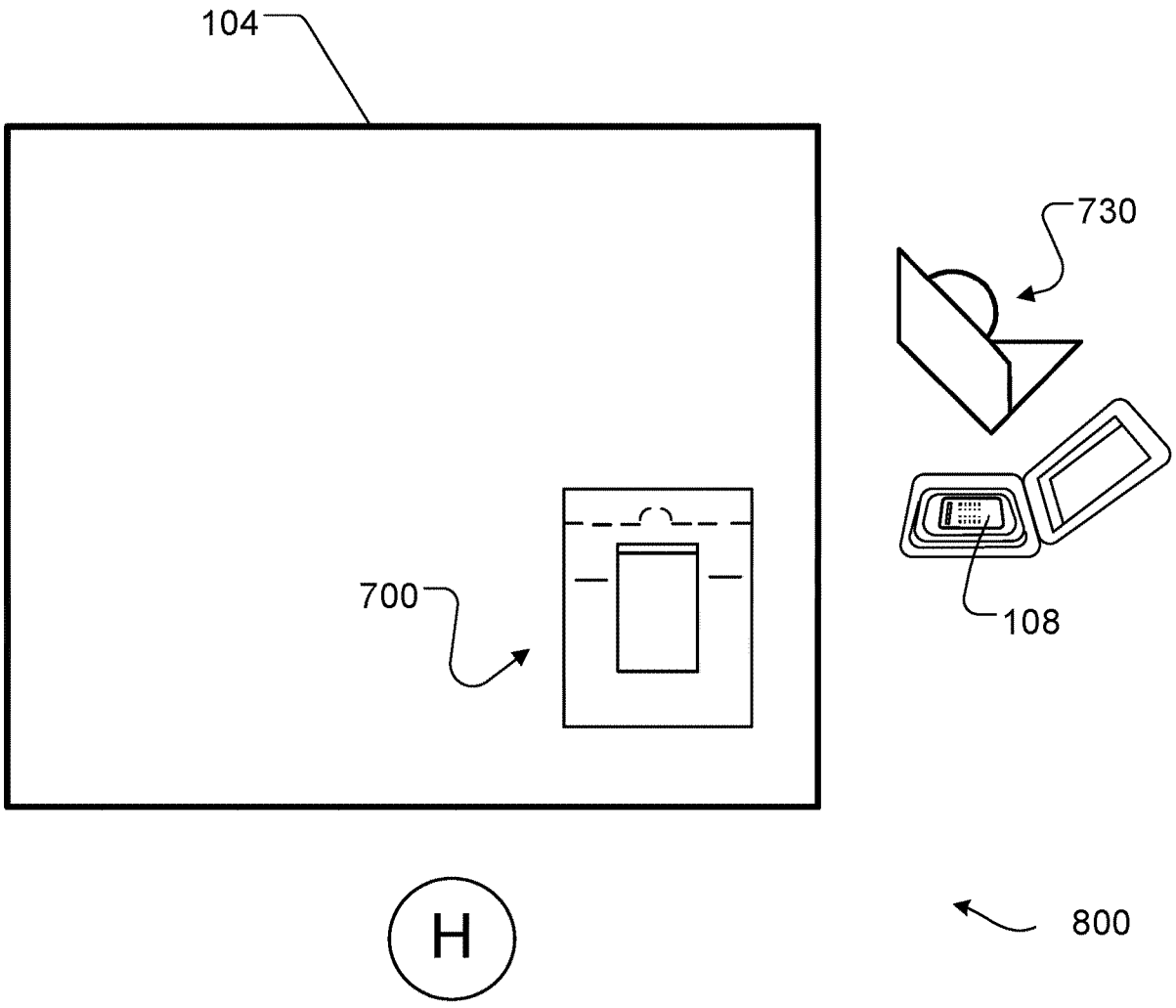

FIG. 8 visually shows the process 800 of assembling the reusable recyclable packing pouch 102, affixing the recyclable pouch 102 to the shipping package 100, and removing the plastic container 104 after shipping. In step A, the monitoring device 108 with the machine readable code 110 is placed in the plastic container 600. In step B, the second portion 604 is snapped shut on the first portion 602 of the plastic container 600. The monitoring device 108 is securely held and protected within the shut plastic container 600. In step C, the plastic container 600 containing the monitoring device 108 is aligned to be placed in the paperboard jacket assembly 700. In step D, the plastic container 600 containing the monitoring device 108 is placed in the paperboard jacket 700.

In step E, the paperboard jacket assembly 700 containing the plastic container 600 with the monitoring device 108 is placed with the first surface 112 (now not shown) down (or away from the person) with the full release liner 746 showing. In step F, the release liner 746 is removed from the paperboard jacket assembly 700 to show the adhesive coating 740. In step G, the paperboard jacket assembly 700 containing the plastic container 600 and the monitoring device 108 with the adhesive coating 740 toward the shipping envelope is affixed onto the shipping package 100. The shipping package 100 is now prepared and ready to be shipped.

After the shipping package 100 has arrived at its final destination, as shown in step H, the perforations 718, 720 are torn and the removing the pull tab 730 is removed, exposing a portion of the plastic container 600. The plastic container 600 is removed from the paperboard jacket assembly 700. The remaining portions of the paperboard jacket 700 can remain on the shipping package 100. The plastic container 600 and the monitoring device 108 can be reused multiple times. After removing from the shipping package 100 at the final destination, the plastic container 600 with monitoring device 108 can be kept together for next use. If the monitoring device 108 is damaged or does not function properly, the first portion 602 of the plastic container 600 can be separated from the second portion 604. The monitoring device 108 can be removed from the plastic container 600 and be replaced with new one. If damaged beyond use, the plastic container 600 can be recycled. The shipping package 100 with the affixed but torn open paperboard jacket 600 can be recycled.

Figure 9:
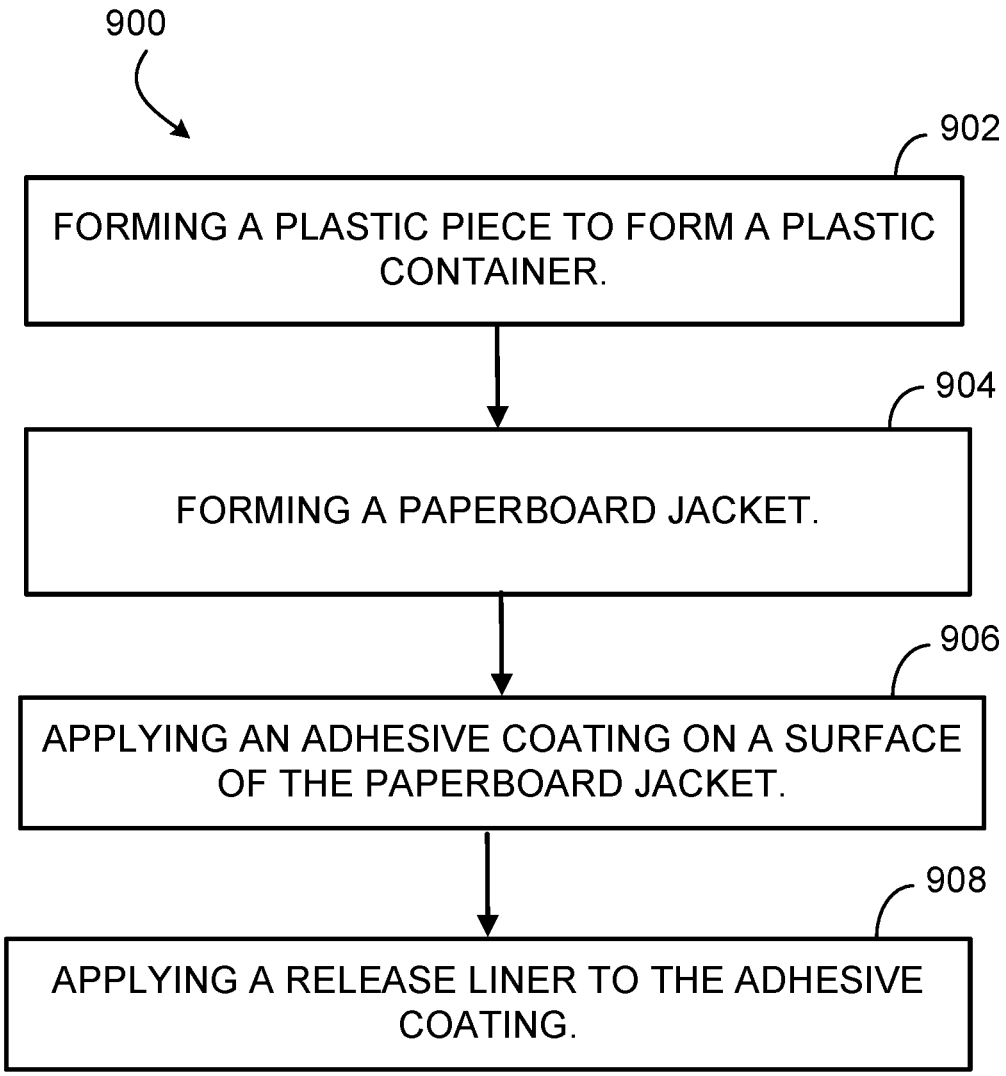
FIG. 9 is an example method of manufacturing the reusable recyclable packing pouch.

FIG. 9 shows an example method 900 of manufacturing the reusable recyclable packing pouch. At 902, a plastic container is formed from a plastic piece. The plastic container includes a first portion and a second portion. The first portion has a shaped region with a flange extending around a perimeter of the shaped region. The second portion sized to mate with the flange such as to define a space between facing surfaces of the second portion and the shaped region of the first portion. The shaped region can be formed to contain shipping documents. The plastic piece can be thermally pressed to form the plastic container. The shaped region can be formed to accommodate a tracking sensor within the space defined between the facing surfaces of the second portion and the shaped region of the first portion. A monitoring device can be attached to the plastic container. The monitoring device can sense a condition of the reusable recyclable packing pouch.

At 904, a paperboard jacket is formed. The paperboard jacket includes an aperture defined therethrough. The aperture is sized to permit the shaped region of the plastic container to pass through while the flange extends past edges of aperture and overlaps with a region of paperboard jacket at a periphery of the aperture. A transparent window can be fixed to the aperture and onto the paperboard jacket to allow a visual sensor to sense a condition within the paperboard jacket. The condition can be an image. The method can include sensing the condition through the transparent window. A front surface of the paperboard jacket can be perforated. Perforating the front surface of the paperboard jacket makes the front surface of the paperboard jacket able to be torn to open the paperboard jacket and remove contents.

At 906, an adhesive coating is applied on a surface of the paperboard jacket. Applying the adhesive coating can include sealing the paperboard jacket shut by the adhesive coating.

At 908, a release liner is attached to an exterior surface of a back sheet via the adhesive coating such that the release liner is removable.

Figure 10A:
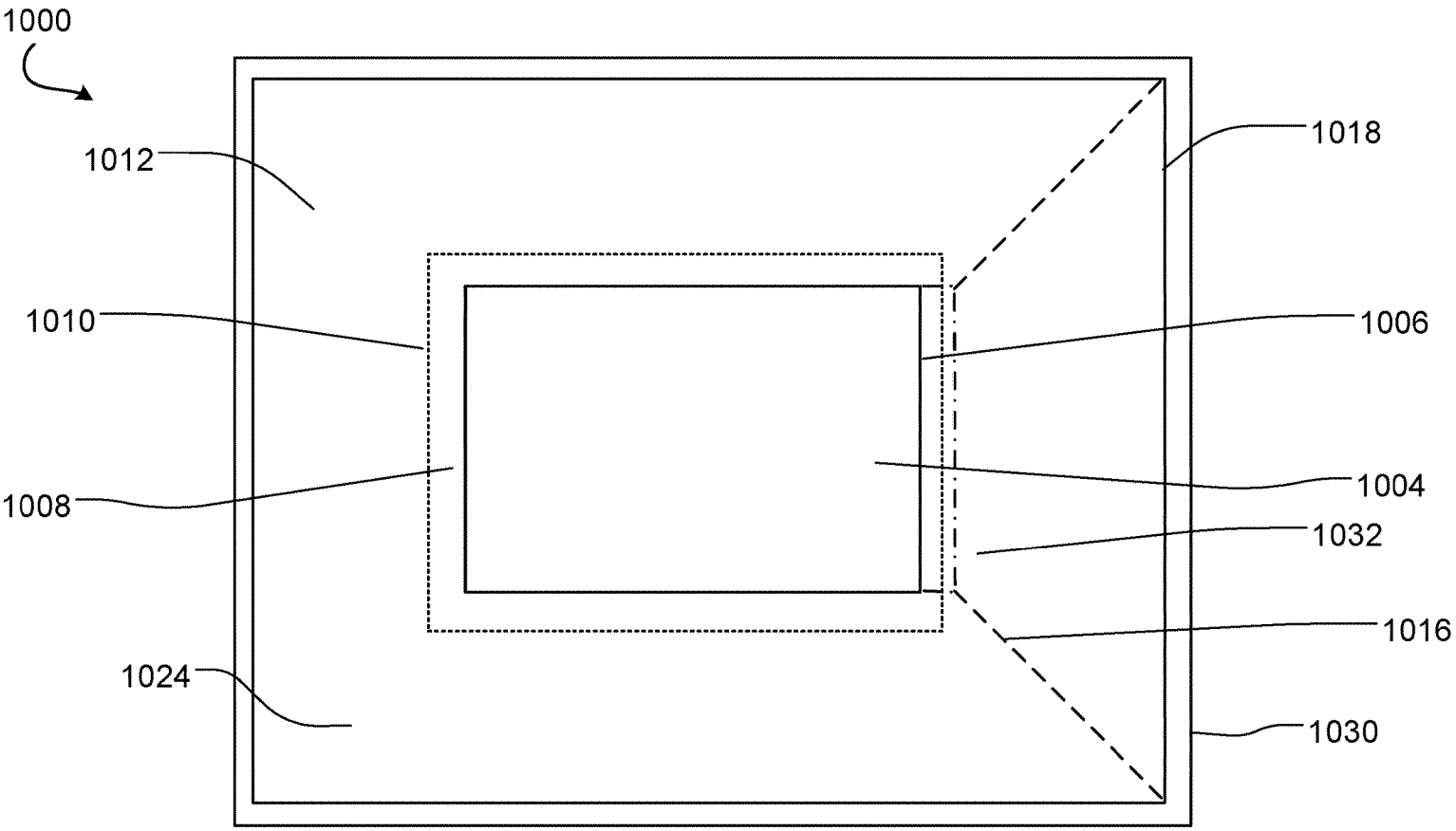
FIG. 10A is a front view of an example paperboard jacket assembly of the reusable recyclable packing pouch of FIG. 1B.
Figure 10B:
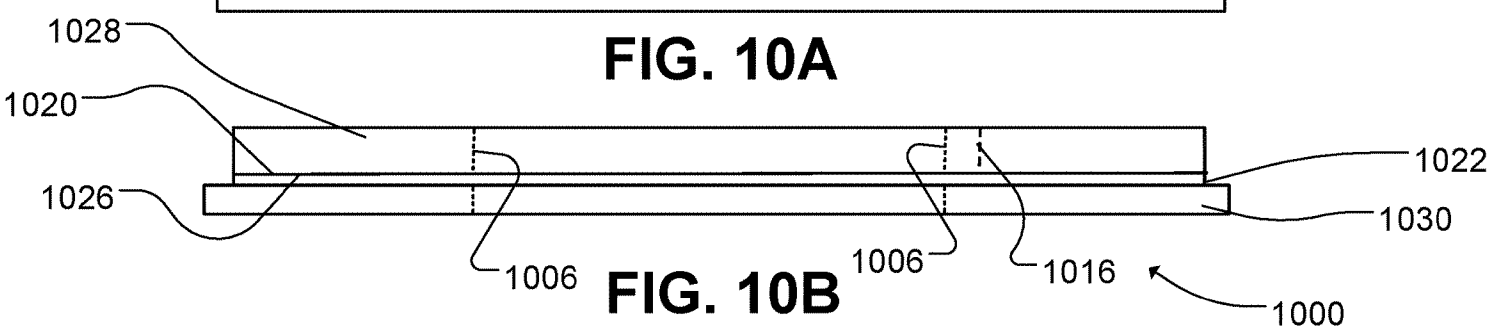
FIG. 10B is a side view of the paperboard jacket assembly of the reusable recyclable packing pouch of FIG. 10A.

FIG. 10A is a front view of another example paperboard jacket assembly 1000 of the reusable recyclable packing pouch of FIG. 1B. FIG. 10B is a side view of the paperboard jacket assembly 1000 of the reusable recyclable packing pouch of FIG. 10A. Referring to FIGS. 10A-10B, the paperboard jacket assembly 1000 has an aperture 1004 defined by a perimeter 1006. The aperture 1004 is sized to permit the first shaped region 208 and the second recessed region 228 of the plastic container 104 to pass through while the first flange 210 and the second flange 238, when coupled together, extend past perimeter 1006 of the aperture 1004. Additionally, the aperture 1004 is sized to overlap with the plastic container 104 in an overlap region 1008 defined by an overlap perimeter 1010. The overlap region 1008 of paperboard jacket assembly 1000 is at a periphery of the aperture 1004 between the aperture perimeter 1006 and the overlap perimeter 1010. The overlap of the first flange 210 coupled to the second flange 238 in the overlap region 1008 holds the plastic container 108 within the paperboard jacket 1000.

The paperboard jacket assembly 1000 can be made from paper, cardboard, or similar materials. Alternatively, the paperboard jacket assembly 1000 can be made from plastics or laminates. The paperboard jacket assembly 1000 can be made from a combination of multiple materials such both paper and plastics.

The paperboard jacket assembly 1000 has a first surface 1012. The first surface 1012, when the paperboard jacket assembly 1000 is affixed to the shipping package 100, is away from the package and toward the person. The paperboard jacket assembly 1000 also has a second surface 1014. The second surface 1014, when the paperboard jacket assembly 1000 is affixed to the shipping package 100, is toward the package and away from the person.

The paperboard jacket assembly 1000 has perforations 1016 extending from the perimeter 1006 of the aperture 1004 to an outer edge 1018 of the paperboard jacket assembly 1000. The perforations 1016 permit tearing and opening of the paperboard jacket 1000 to remove the plastic container 104 at the termination of shipping. The perforations 1016 can extend from the first surface 1012 to the second surface 1020, shown in FIG. 10B. Alternatively, the perforations 1016 may not necessarily extend entirely from the first surface 1012 to the second surface 1020. This can be referred to as scoring. The perforations 1016 and a portion of the edge 1018 define a perforated tab section 1032. The perforations 1016 can be torn to remove the perforated tab section 1032, exposing the contents of the paperboard jacket assembly 1000. Other easy open/tear features can be included in the paperboard jacket assembly 1000 for easy opening.

An adhesive coating 1022 is located on the second surface 1020 of the paperboard jacket assembly 1000. The adhesive coating 1022 is located within a second region 1024 of the paperboard jacket that does not overlap with the overlap region 1008 of paperboard jacket assembly 1000 at a periphery of the aperture 1004. The second region 1024 is the adhesive region. The adhesive coating 1022 affixes the paperboard jacket assembly 1000 to the shipping package 100. The adhesive coating 1022 can include acrylic adhesives. The adhesive coating 1022 can be a permanent adhesive. The permanent adhesive is an adhesive coating 1022 that once the bond of the permanent adhesive is broken, the adhesive no longer functions as an adhesive (i.e., a permanent adhesive is not resealable). Moreover, bond strength of a permanent adhesive is typically much higher than that of a resealable adhesive. For example, the bonding strength of a permanent adhesive is much higher than the force required to open the resealable adhesive without failing, separating, or peeling. The adhesive coating 1022 has enough adhesion strength to survive the roughness of the shipping environment in order to prevent the paperboard jacket assembly 1000 from rubbed open and/or ripping off. The adhesive coating 1022 has a first surface 1026. The first surface 1026 is coupled to the paperboard jacket 1000. The adhesive coating 1022 also has a second surface 1028. The adhesive coating 1022 can be a double-sided adhesive tape (i.e., a plastic strip/carrier) with a permanent adhesive.

The paperboard jacket assembly 1000 includes a release liner 1030. The release liner 1030 is attached to the second surface 1028 of the adhesive coating 1022. The release liner 1030 can be formed of a paper material coated with a release agent such as silicone. The release liner 1030 would be removed before affixing the reusable recyclable packing pouch 1000 to shipping package 100 via the exposed adhesive coating 1022. The release liner 1030 is attached to the exterior surface of paperboard jacket assembly 1000 to cover and protect the adhesive coating 1022 until reusable recyclable packing pouch 100 is ready to be attached to the shipping package 100.

The paperboard jacket assembly 1000 can include a transparent plastic sheet (not shown) affixed to the second surface 1020 of the paperboard jacket 1000 in the overlap region 1008. The transparent plastic sheet covers the aperture 1004. The transparent plastic sheet allows transmission of light into the paperboard jacket assembly 1000 and a person or machine to view and scan the contents (the monitoring device 108 and/or the packing slip). The transparent plastic sheet can be used if a packing slip is to be used, or if the monitoring device 108 is sufficiently thin or additional protection is not required.

EMBODIMENTS

In an example aspect, a reusable recyclable packing pouch has a plastic container and a paperboard jacket. The plastic container includes a first portion and a second portion. The first portion has a shaped region. The second portion is coupled to the first portion by a hinge. The second portion is sized to mate with the first portion such as to define a space between facing surfaces of the second portion and the shaped region of the first portion. When the first portion and the second portion are coupled, the plastic container has a flange extending annularly around the shaped region. The paperboard jacket includes an aperture, a first set of perforations, and a second set of perforations. The aperture is defined through the paperboard jacket, The aperture is sized to permit the shaped region of the plastic container to pass through while the flange extends past edges of aperture and overlaps with a region of the paperboard jacket at a periphery of the aperture. The first set of perforations extend across the paperboard jacket from one outer edge to another outer edge. The second set of perforations is parallel with, but offset from, the first set of perforations. The second set of perforations is interrupted by the aperture.

In an example aspect combinable with any other example aspect, a region between the first set of perforations and the second set of perforations forms a pull tab. The paperboard jacket includes a rigid backing applied to the pull tab.

In an example aspect combinable with any other example aspect, the rigid backing is plastic.

In an example aspect combinable with any other example aspect, an edge of the rigid backing aligns with at least one of the first set of perforations or the second set of perforations.

In an example aspect combinable with any other example aspect, the rigid backing extends across the paperboard jacket from the one outer edge to the another outer edge.

In an example aspect combinable with any other example aspect, the paperboard jacket has a first paperboard layer and a second paperboard layer. A portion of the rigid backing is sandwiched between the first paperboard layer and the second paperboard layer.

In an example aspect combinable with any other example aspect, the paperboard jacket includes a first paperboard layer overlaying a second paperboard layer. The first paperboard layer defines the aperture. The second paperboard layer defines a second aperture that is larger than the aperture. The outer edges of the first paperboard layer are aligned with outer edges of the second paperboard layer.

In an example aspect combinable with any other example aspect, the second paperboard layer has a thickness approximately equal to a thickness of the flange.

In an example aspect combinable with any other example aspect, the flange of the plastic container includes, with the first portion and the second portion coupled, a first flange overlaying a second flange, the first flange extending around a perimeter the shaped region of the first portion of the plastic container and the second flange extending around a perimeter of the shaped region of the second portion of the plastic container. The thickness of the second paperboard layer is approximately equal to a combined thickness of the first flange overlayed on the second flange.

In an example aspect combinable with any other example aspect, the plastic container includes projections extending outward from a sidewall and over the flange.

In an example aspect combinable with any other example aspect, a distance between each projection and the flange is approximately equal to a thickness of the paperboard jacket.

In an example aspect combinable with any other example aspect, a region between the first set of perforations and the second set of perforations forms a pull tab. The paperboard jacket includes a rigid plastic backing applied to the pull tab and extending across the paperboard jacket from the one outer edge to the other outer edge. An edge of the rigid backing aligns with at least one of the first set of perforations or the second set of perforations. The paperboard jacket includes a first paperboard layer and a second paperboard layer. A portion of the rigid backing is sandwiched between the first paperboard layer and the second paperboard layer.

The first paperboard layer defines the aperture. The second paperboard layer defines a second aperture that is larger than the aperture. Outer edges of the first paperboard layer are aligned with outer edges of the second paperboard layer. The second paperboard layer has a thickness approximately equal to a thickness of the flange.

The flange of the plastic container includes, with the first portion and the second portion coupled, a first flange overlaying a second flange. The first flange extends around a perimeter the shaped region of the first portion of the plastic container and the second flange extends around a perimeter of the shaped region of the second portion of the plastic container. The thickness of the second paperboard layer is approximately equal to a combined thickness of the first flange overlayed on the second flange. The plastic container has projections extending outward from a sidewall and over the flange. A distance between each projection and the flange is approximately equal to a thickness of the paperboard jacket. In an example aspect combinable with any other example aspect, In another example aspect, a shipping container has a reusable recyclable packing pouch. The reusable recyclable packing pouch includes a plastic container and a paperboard jacket. The plastic container is positioned on a surface of the shipping container. The plastic container has a first portion and a second portion. The first portion has a shaped region. The second portion is coupled to the first portion by a hinge. The second portion is sized to mate with the first portion such as to define a space between facing surfaces of the second portion and the shaped region of the first portion. When the first portion and the second portion are coupled, the plastic container has a flange extending annularly around the shaped region. The paperboard jacket includes an aperture, a first set of perforations, and a second set of perforations. The aperture is defined through the paperboard jacket. The aperture is sized to permit the shaped region of the plastic container to pass through while the flange extends past edges of aperture and overlaps with a region of paperboard jacket at a periphery of the aperture. The first set of perforations extends across the paperboard jacket from one outer edge to another outer edge. The second set of perforations is parallel with, but offset from, the first set of perforations. The second set of perforations is interrupted by the aperture.

In an example aspect combinable with any other example aspect, a region between the first set of perforations and the second set of perforations forms a pull tab. The paperboard jacket includes a rigid plastic backing applied to the pull tab and extending across the paperboard jacket from the one outer edge to the other outer edge. An edge of the rigid backing aligns with at least one of the first set of perforations or the second set of perforations. The paperboard jacket includes a first paperboard layer and a second paperboard layer. A portion of the rigid backing is sandwiched between the first paperboard layer and the second paperboard layer.

In an example aspect combinable with any other example aspect, the first paperboard layer defines the aperture. The second paperboard layer defines a second aperture that is larger than the aperture. Outer edges of the first paperboard layer are aligned with outer edges of the second paperboard layer. The second paperboard layer has a thickness approximately equal to a thickness of the flange.

In an example aspect combinable with any other example aspect, the flange of the plastic container includes, with the first portion and the second portion coupled, a first flange overlaying a second flange. The first flange extends around a perimeter the shaped region of the first portion of the plastic container and the second flange extends around a perimeter of the shaped region of the second portion of the plastic container. The thickness of the second paperboard layer is approximately equal to a combined thickness of the first flange overlayed on the second flange. The plastic container has projections extending outward from a sidewall and over the flange. A distance between each projection and the flange is approximately equal to a thickness of the paperboard jacket.

In yet another example aspect, a reusable recyclable packing pouch is made. The reusable recyclable packing pouch is made by forming a plastic piece to form a plastic container. The plastic container has a first portion and a second portion. The first portion has a shaped region. The second portion is coupled to the first portion by a hinge. The second portion is sized to mate with the first portion such as to define a space between facing surfaces of the second portion and the shaped region of the first portion. When the first portion and the second portion are coupled, the plastic container includes a flange extending annularly around the shaped region. Making the reusable recyclable packing pouch includes forming a paperboard jacket. The paperboard jacket has an aperture, a first set of perforations, and a second set of perforations. The aperture is defined through the paperboard jacket. The aperture is sized to permit the shaped region of the plastic container to pass through while the flange extends past edges of aperture and overlaps with a region of paperboard jacket at a periphery of the aperture. The first set of perforations extends across the paperboard jacket from one outer edge to another outer edge. The second set of perforations is parallel with, but offset from, the first set of perforations. The second set of perforations is interrupted by the aperture.

In an example aspect combinable with any other example aspect, a region between the first set of perforations and the second set of perforations forms a pull tab. The paperboard jacket has a rigid plastic backing applied to the pull tab and extending across the paperboard jacket from the one outer edge to the other outer edge. The edge of the rigid backing aligns with at least one of the first set of perforations or the second set of perforations. The paperboard jacket has a first paperboard layer and a second paperboard layer. A portion of the rigid backing is sandwiched between the first paperboard layer and the second paperboard layer.

While this specification contains many specific implementation details, these should not be construed as limitations on the scope of any invention or on the scope of what may be claimed, but rather as descriptions of features that may be specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable sub-combination. Moreover, although features may be described above as acting in certain combinations and even initially claimed as such, one or more features from a claimed combination can in some cases be excised from the combination, and the claimed combination may be directed to a sub combination or variation of a sub-combination.

While this document contains many specific implementation details, these should not be construed as limitations on the scope of what may be claimed, but rather as descriptions of features that may be specific to particular implementations or embodiments. Certain features that are described in this specification in the context of separate embodiments can also be implemented in combination in a single embodiment. Conversely, various features that are described in the context of a single embodiment can also be implemented in multiple embodiments separately or in any suitable sub combination. Moreover, although features may be described above as acting in certain combinations and even initially claimed as such, one or more features from a claimed combination can, in some cases, be excised from the combination, and the claimed combination may be directed to a sub combination or variation of a sub combination.

As used herein, the terms "orthogonal", "substantially orthogonal", "perpendicular" or "substantially perpendicular" refer to a relation between two elements (e.g., lines, axes, planes, surfaces, or components) that forms a ninety degree (perpendicular) angle within acceptable engineering, machining, or measurement tolerances. For example, two surfaces can be considered orthogonal to each other if the angle between the surfaces is within an acceptable tolerance of ninety degrees (e.g., ±1-2 degrees).

As used herein, the terms "aligned," "substantially aligned," "parallel," or "substantially parallel" refer to a relation between two elements (e.g., lines, axes, planes, surfaces, or components) as being oriented generally along the same direction within acceptable engineering, machining, drawing measurement, or part size tolerances such that the elements do not intersect or intersect at a minimal angle. For example, two surfaces can be considered aligned with each other if surfaces extend along the same general direction of a device.

As used herein, the terms "equal," "substantially equal," "same," "corresponds," or "approximately equal" refer to a relation between two elements (e.g., lines, axes, planes, surfaces, or components) as being generally the same within acceptable engineering, machining, drawing measurement, or part size tolerances such that the elements generally are the same. For example, two dimensions can be considered equal with each other if the dimensions are generally the same.

The invention claimed is:

1. A reusable recyclable packing pouch comprising:

a plastic container comprising:

first portion with a shaped region, and a second portion coupled to the first portion by a hinge, the second portion sized to mate with the first portion such as to define a space between facing surfaces of the second portion and the shaped region of the first portion, wherein, when the first portion and the second portion are coupled, the plastic container comprises a flange extending annularly around the shaped region; and a paperboard jacket comprising:

an aperture defined therethrough, wherein the aperture is sized to permit the shaped region of the plastic container to pass through while the flange extends past edges of aperture and overlaps with a region of the paperboard jacket at a periphery of the aperture;

a pull tab formed between a first set of perforations and a second set of perforations;

a rigid backing applied to the pull tab, and wherein:

the first set of perforations extends across the paperboard jacket from one outer edge to another outer edge; and the second set of perforations is offset from the first set of perforations, and the second set of perforations is interrupted by the aperture.

2. The reusable recyclable packing pouch of claim 1, wherein the rigid backing comprises plastic.

3. The reusable recyclable packing pouch of claim 1, wherein an edge of the rigid backing aligns with at least one of the first set of perforations or the second set of perforations.

4. The reusable recyclable packing pouch of claim 1, wherein the rigid backing extends across the paperboard jacket from the one outer edge to the another outer edge.

5. The reusable recyclable packing pouch of claim 1, wherein the paperboard jacket comprises a first paperboard layer and a second paperboard layer, and wherein a portion of the rigid backing is sandwiched between the first paperboard layer and the second paperboard layer.

6. The reusable recyclable packing pouch of claim 1, wherein the paperboard jacket comprises a first paperboard layer overlaying a second paperboard layer, wherein the first paperboard layer defines the aperture, wherein the second paperboard layer defines a second aperture that is larger than the aperture, and wherein outer edges of the first paperboard layer are aligned with outer edges of the second paperboard layer.

7. The reusable recyclable packing pouch of claim 6, wherein the second paperboard layer has a thickness approximately equal to a thickness of the flange.

8. The reusable recyclable packing pouch of claim 7, wherein the flange of the plastic container comprises, with the first portion and the second portion coupled, a first flange overlaying a second flange, the first flange extending around a perimeter the shaped region of the first portion of the plastic container and the second flange extending around a perimeter of the shaped region of the second portion of the plastic container, and wherein the thickness of the second paperboard layer is approximately equal to a combined thickness of the first flange overlayed on the second flange.

9. The reusable recyclable packing pouch of claim 1, wherein the plastic container comprises a plurality of projections extending outward from a sidewall and over the flange.

10. The reusable recyclable packing pouch of claim 9, wherein a distance between each projection and the flange is approximately equal to a thickness of the paperboard jacket.

11. The reusable recyclable packing pouch of claim 1, wherein the rigid backing applied to the pull tab is plastic and extends across the paperboard jacket from the one outer edge to the other outer edge, wherein an edge of the rigid backing aligns with at least one of the first set of perforations or the second set of perforations, and wherein the paperboard jacket comprises a first paperboard layer and a second paperboard layer, and wherein a portion of the rigid backing is sandwiched between the first paperboard layer and the second paperboard layer.

12. The reusable recyclable packing pouch of claim 11, wherein the first paperboard layer defines the aperture, wherein the second paperboard layer defines a second aperture that is larger than the aperture, and wherein outer edges of the first paperboard layer are aligned with outer edges of the second paperboard layer, and wherein the second paperboard layer has a thickness approximately equal to a thickness of the flange.

13. The reusable recyclable packing pouch of claim 12, wherein the flange of the plastic container comprises, with the first portion and the second portion coupled, a first flange overlaying a second flange, the first flange extending around a perimeter the shaped region of the first portion of the plastic container and the second flange extending around a perimeter of the shaped region of the second portion of the plastic container, wherein the thickness of the second paperboard layer is approximately equal to a combined thickness of the first flange overlayed on the second flange, wherein the plastic container comprises a plurality of projections extending outward from a sidewall and over the flange, and wherein a distance between each projection and the flange is approximately equal to a thickness of the paperboard jacket.

14. A shipping container with a reusable recyclable packing pouch, the shipping container comprising:

a plastic container positioned on a surface of the shipping container, the plastic container comprising:

first portion with a shaped region, and a second portion coupled to the first portion by a hinge, the second portion sized to mate with the first portion such as to define a space between facing surfaces of the second portion and the shaped region of the first portion, wherein, when the first portion and the second portion are coupled, the plastic container comprises a flange extending annularly around the shaped region; and a paperboard jacket comprising:

an aperture defined therethrough, wherein the aperture is sized to permit the shaped region of the plastic container to pass through while the flange extends past edges of aperture and overlaps with a region of paperboard jacket at a periphery of the aperture;

a first set of perforations extending across the paperboard jacket from one outer edge to another outer edge; and a second set of perforations offset from the first set of perforations and parallel with at least a portion of the first set of perforations, wherein the second set of perforations is interrupted by the aperture.

15. The shipping container of claim 14, wherein a region between the first set of perforations and the second set of perforations forms a pull tab, wherein the paperboard jacket comprises a rigid plastic backing applied to the pull tab and extending across the paperboard jacket from the one outer edge to the other outer edge, wherein an edge of the rigid plastic backing aligns with at least one of the first set of perforations or the second set of perforations, and wherein the paperboard jacket comprises a first paperboard layer and a second paperboard layer, and wherein a portion of the rigid plastic backing is sandwiched between the first paperboard layer and the second paperboard layer.

16. The shipping container of claim 15, wherein the first paperboard layer defines the aperture, wherein the second paperboard layer defines a second aperture that is larger than the aperture, and wherein outer edges of the first paperboard layer are aligned with outer edges of the second paperboard layer, and wherein the second paperboard layer has a thickness approximately equal to a thickness of the flange.

17. The shipping container of claim 16, wherein the flange of the plastic container comprises, with the first portion and the second portion coupled, a first flange overlaying a second flange, the first flange extending around a perimeter the shaped region of the first portion of the plastic container and the second flange extending around a perimeter of the shaped region of the second portion of the plastic container, wherein the thickness of the second paperboard layer is approximately equal to a combined thickness of the first flange overlayed on the second flange, wherein the plastic container comprises a plurality of projections extending outward from a sidewall and over the flange, and wherein a distance between each projection and the flange is approximately equal to a thickness of the paperboard jacket.

18. The shipping container of claim 14, wherein the paperboard jacket comprises a pull tab formed between the first set of perforation and the second set of perforations, the pull tab comprising a plastic backing.

19. The shipping container of claim 14, wherein the plastic container comprises one or more projections extending from a sidewall and configured to retain at least one layer of the paperboard jacket captured between respective bottom surfaces of the one or more projections and the flange.

20. The shipping container of claim 18, wherein the plastic container comprises one or more projections extending from a sidewall and configured to retain at least one layer of the paperboard jacket captured between respective bottom surfaces of the one or more projections and the flange, and wherein at least one of the one or more projections overlaps the pull tab.

21. The reusable recyclable packing pouch of claim 1, wherein the plastic container comprises one or more projections extending from a sidewall and configured to retain at least one layer of the paperboard jacket captured between respective bottom surfaces of the one or more projections and the flange, and wherein at least one of the one or more projections overlaps the pull tab.

* * * * *